US012808091B2

(12) United States Patent
Yang et al.

(10) Patent No.: US 12,808,091 B2
(45) Date of Patent: Nov. 24, 2026

(54) POLYESTER INDUSTRIAL YARN DEDICATED TO MARINE HAWSER AND PREPARATION METHOD THEREOF

(71) Applicant: ZHEJIANG KINGSWAY HIGH-TECH FIBER CO., LTD, Haining (CN)

(72) Inventors: Yulong Yang, Haining (CN); Yahui Gao, Haining (CN); Chenggang Wang, Haining (CN); Changming Jiang, Haining (CN); Shiguang Gong, Haining (CN); Jian Zhang, Haining (CN); Haiqiang Liao, Haining (CN); Renping Yang, Haining (CN); Tianyuan Qian, Haining (CN)

(73) Assignee: ZHEJIANG KINGSWAY HIGH-TECH FIBER CO., LTD, Haining (CN)

( * ) Notice: Subject to any disclaimer, the term of this patent is extended or adjusted under 35 U.S.C. 154(b) by 294 days.

(21) Appl. No.: 18/692,714

(22) PCT Filed: May 22, 2023

(86) PCT No.: PCT/CN2023/095437
§ 371 (c)(1),
(2) Date: Mar. 15, 2024

(87) PCT Pub. No.: WO2023/231813
PCT Pub. Date: Dec. 7, 2023

(65) Prior Publication Data

US 2024/0376641 A1 Nov. 14, 2024

(30) Foreign Application Priority Data

May 31, 2022 (CN) ..... 202210612665.2

(51) Int. Cl.

| | |
|---|---|
| ***D01F 6/92*** | (2006.01) |
| ***B63B 21/20*** | (2006.01) |
| ***D01F 1/10*** | (2006.01) |
| ***D01F 11/08*** | (2006.01) |
| *D06M 101/32* | (2006.01) |

(52) U.S. Cl.
CPC ..... *D01F 6/92* (2013.01); *B63B 21/20* (2013.01); *D01F 1/103* (2013.01); *D01F 1/106* (2013.01); *D01F 11/08* (2013.01); *B63B 2021/203* (2013.01); *D06M 2101/32* (2013.01); *D06M 2200/25* (2013.01)

(58) Field of Classification Search
CPC ..... D01F 6/92; D01F 1/103; D01F 1/106; D01F 11/08; B63B 21/20
See application file for complete search history.

(56) References Cited

FOREIGN PATENT DOCUMENTS

| | | | | |
|---|---|---|---|---|
| CN | 103060942 A | * | 4/2013 | |
| CN | 104018239 A | * | 9/2014 | |
| CN | 106119983 A | * | 11/2016 | ..... D01D 5/16 |
| CN | 108707425 A | * | 10/2018 | ..... C09J 4/06 |
| CN | 108996541 A | * | 12/2018 | ..... C05C 3/00 |
| CN | 111501361 A | * | 8/2020 | ..... D06N 3/141 |
| CN | 113584672 A | * | 11/2021 | ..... D01F 1/10 |
| CN | 113846389 A | * | 12/2021 | ..... D01F 1/07 |
| CN | 215103959 U | * | 12/2021 | |

* cited by examiner

*Primary Examiner* — JaMel M Nelson
(74) *Attorney, Agent, or Firm* — AVEK IP, LLC

(57) ABSTRACT

Embodiments of a polyester industrial yarn dedicated to a marine hawser and a preparation method thereof, relating to the technical field of industrial yarns, are disclosed. In some examples, the preparation method includes: S1, preparing a regenerated polyester chip; S2, high-viscosity anti-ultraviolet modified polyester chip; S3, antibacterial master batch; S4, mixing the high-viscosity anti-ultraviolet modified polyester chip and the antibacterial master batch, subjecting a resulting mixture to extruding and melting to form a spinning melt, and metering, spinning, and cooling to form a tow; S5, spraying a waterproof and acid- and alkali-resistant layer onto a surface of the tow; S6, subjecting the tow to first oiling; and S7, subjecting the tow to heat-setting of two-stage drawing and one-stage relaxation, network processing, second oiling, and winding forming, to obtain the polyester industrial yarn dedicated to the marine hawser.

16 Claims, No Drawings

POLYESTER INDUSTRIAL YARN DEDICATED TO MARINE HAWSER AND PREPARATION METHOD THEREOF

CROSS REFERENCE TO RELATED APPLICATIONS

This application is the United State national stage entry under 37 U.S.C. 371 of PCT/CN2023/095437, filed on May 22, 2023, which claims priority to Chinese application number 202210612665.2, filed on May 31, 2022, the disclosure of which are incorporated by reference herein in their entireties.

FIELD OF THE DISCLOSURE

The disclosure relates generally to the field of industrial yarns. More specifically, the disclosure relates to polyester industrial yarns dedicated to marine hawsers and preparation methods thereof.

BACKGROUND

Traditional marine hawsers are generally steel wire ropes, and have poor corrosion resistance and easy to rust in a seawater environment. In recent years, with the development of ocean engineering industry and the continuous innovation of high-performance lightweight fibers, the chemical fibers dedicated to hawsers have been widely used in the fields of wharf mooring, towing hawsers, hoisting hawsers and single-point mooring. Polyester industrial yarns are common materials dedicated to marine hawsers; however, existing polyester industrial yarns are easily corroded by acid/alkali and aged due to the influence of factors such as salts, bacteria, sunlight, considering its presence in seawater for a long time and immersion in seawater, thereby leading to a short service life.

SUMMARY

The following presents a simplified summary of the invention in order to provide a basic understanding of some aspects of the invention. This summary is not an extensive overview of the invention. It is not intended to identify critical elements or to delineate the scope of the invention. Its sole purpose is to present some concepts of the invention in a simplified form as a prelude to the more detailed description that is presented elsewhere.

In some embodiments, the disclosure provides method for preparing a polyester industrial yarn dedicated to a marine hawser, including following steps.

S1, preparing a regenerated polyester chip.

S2, blending the regenerated polyester chip in S1 with an anti-ultraviolet agent, polymerizing a resulting mixture of the regenerated polyester chip in S1 and the anti-ultraviolet agent, and granulating and tackifying the polymerized resulting mixture to obtain a high-viscosity anti-ultraviolet modified polyester chip.

S3, mixing the regenerated polyester chip in S1 with an antibacterial agent and melt granulating a resulting mixture of the regenerated polyester chip in S1 and the antibacterial agent to obtain an antibacterial master batch.

S4, mixing the high-viscosity anti-ultraviolet modified polyester chip obtained in S2 and the antibacterial master batch obtained in S3, extruding and melting the resulting mixture to form a spinning melt, and metering and spinning to form a tow.

S5, spraying a waterproof, acid-resistant, and alkali-resistant layer onto a surface of the tow obtained in S4.

S6, subjecting the tow in S5 to first oiling.

S7, subjecting the tow in S6 to heat-setting of two-stage drawing and one-stage relaxation, network processing, second oiling, and winding forming to obtain the polyester industrial yarn dedicated to the marine hawser.

Optionally, in S5, raw materials for the waterproof, acid-resistant, and alkali-resistant layer include, in parts by weight: 30-45 parts of a waterborne polyurethane, 15-25 parts of a dispersant, 4-6 parts of silicon carbide, 10-20 parts of chitosan, 15-30 parts of sodium selenite, 5-6 parts of carbon nanotubes, 6-8 parts of titanium dioxide nanofibers, 20-35 parts of glycidyl ester epoxy resin, 3-10 parts of polytetramethylene ether glycol, 2-4 parts of butyl acrylate, 3-6 parts of polymaleic acid vinyl acid, 4-7 parts of dithiol succinate, 3-5 parts of polyurethane, 2-5 parts of dioctyl phthalate, 25-35 parts of deionized water, 10-15 parts of anhydrous ethanol, and 2-3 parts of acetic acid.

Optionally, the waterproof, acid-resistant, and alkali-resistant layer is prepared by following steps.

Mixing silicon carbide and a part of the dispersant, and ball milling a resulting mixture in a ball mill for 15-25 min, performing microwave heat treatment for 6-12 s, and taking out; adding a resulting product into a part of the waterborne polyurethane, ultrasonically dispersing for 8-18 min, cooling at a temperature of 0-3° C. for 2-4 h, leaving to stand at a temperature of 85-95° C. for 3-5 h, filtering, drying a resulting solid at a temperature of 40-50° C., and ball milling to a particle size of 15-50 nm, to obtain a modified silicon carbide.

Dissolving sodium selenite in a part of deionized water to obtain a sodium selenite solution with a concentration of 15-35 mg/L, adding chitosan into the sodium selenite solution, mixing, heating a resulting mixture to a temperature of 50-60° C., stirring, subjecting a resulting mixture to rotatory evaporation under vacuum at a temperature of 55-60° C., performing ultraviolet intermittent irradiation, then performing heat preservation for 30-45 min, and freeze-drying, to obtain a modified chitosan.

Mixing the carbon nanotubes and the modified chitosan, adding a remaining deionized water, ultrasonically dispersing for 10-15 min, adding titanium dioxide nanofibers, the modified silicon carbide and acetic acid thereto, mixing, adding glycidyl ester epoxy resin and anhydrous ethanol thereto, heating a resulting mixture to a temperature of 40-60° C., keeping at 40-60° C. while stirring for 30-45 min, and defoaming to obtain a mixed stock solution.

Mixing polytetramethylene ether glycol, butyl acrylate, polymaleic acid vinyl acid, dithiol succinate, polyurethane and dioctyl phthalate, heating a resulting mixture to a temperature of 110-130° C., keeping at 110-130° C. for 10-30 min, then adding a remaining waterborne polyurethane and a remaining dispersant thereto, mixing, further heating to a temperature of 150-180° C., keeping at 150-180° C. for 30-50 min, cooling to room temperature; and adding the mixed stock solution thereto, mixing, heating to a temperature of 80-90° C., keeping at 80-90° C. for 1-3 h, stirring at a rotating speed of 1500-2500 r/min for 20-40 min, cooling to room temperature, and spraying onto the surface of the tow.

Optionally, the dispersant is sodium alginate.

Optionally, the dispersant is sodium alginate.

Optionally, in S2, a mass ratio of the anti-ultraviolet agent to the regenerated polyester chip is in a range of (1-5):(95-99).

Optionally, raw materials for the anti-ultraviolet agent include, in parts by weight: 10-20 parts of polypropylene resin, 5-7 parts of carbon nanotubes, 2-6 parts of nano titanium dioxide, 4-8 parts of nano zinc oxide, 5-7 parts of polyphenylene sulfide, 2-6 parts of butyl acrylate, 2-3 parts of zinc sulfate, 0.5-3 parts of attapulgite clay, 1-2 parts of diatomite, 1-3 parts of sodium α-olefin sulfonate, 1-2 parts of dibutyltin laurate, 1-2 parts of ammonium triphosphate, 1-2 parts of acrylamide, 1-4 parts of silane coupling agent KH-550, 20-35 parts of water, 1-3 parts of glycerol diacetate, and 2-5 parts of N,N-methylenebis(acrylamide).

Optionally, raw materials for the anti-ultraviolet agent include, in parts by weight: 10-20 parts of polypropylene resin, 5-7 parts of carbon nanotubes, 2-6 parts of nano titanium dioxide, 4-8 parts of nano zinc oxide, 5-7 parts of polyphenylene sulfide, 2-6 parts of butyl acrylate, 2-3 parts of zinc sulfate, 0.5-3 parts of attapulgite clay, 1-2 parts of diatomite, 1-3 parts of sodium α-olefin sulfonate, 1-2 parts of dibutyltin laurate, 1-2 parts of ammonium triphosphate, 1-2 parts of acrylamide, 1-4 parts of silane coupling agent KH-550, 20-35 parts of water, 1-3 parts of glycerol diacetate, and 2-5 parts of N,N-methylenebis(acrylamide).

Optionally, the anti-ultraviolet agent is prepared by following steps.

Mixing polypropylene resin, polyphenylene sulfide, butyl acrylate, and nano zinc oxide, stirring at a temperature of 85-100° C. for 18-25 h, and cooling to room temperature, to obtain a first material.

Mixing carbon nanotubes, nano titanium dioxide, zinc sulfate, attapulgite clay, diatomite, sodium α-olefin sulfonate, dibutyltin laurate, ammonium tripolyphosphate, acrylamide, and water, heating a resulting mixture to a temperature of 85-115° C., keeping at 85-115° C. for 2-6 hours, adding N,N-methylenebis(acrylamide) and glycerol diacetate thereto, mixing, then cooling to a temperature of 35-60° C., filtering, washing, drying at a temperature of 90-120° C. for 2-7 hours, and cooling to room temperature, to obtain a second material.

Mixing the first material, the second material, and the silane coupling agent KH-550, heating a resulting mixture to a temperature of 85-95° C., keeping at 85-95° C. for 15-25 min, stirring at a rotational speed of 600-900 r/min for 10-20 min, and then cooling to room temperature, to obtain the anti-ultraviolet agent.

Optionally, in S3, a mass ratio of the regenerated polyester chip to the antibacterial agent is in a range of (59.5-69.5):(30.5-40.5).

Optionally, raw materials for the antibacterial agent include, in parts by weight: 15-25 parts of nano zinc oxide, 7-15 parts of diatomite, 3-6 parts of cobalt nitrate hexahydrate, 2-6 parts of ammonium bicarbonate, 2-4 parts of glacial acetic acid, 20-50 parts of anhydrous ethanol, 2-6 parts of silver nitrate, 2-4 parts of sodium hydroxide, and 15-30 parts of deionized water.

Optionally, raw materials for the antibacterial agent include, in parts by weight: 15-25 parts of nano zinc oxide, 7-15 parts of diatomite, 3-6 parts of cobalt nitrate hexahydrate, 2-6 parts of ammonium bicarbonate, 2-4 parts of glacial acetic acid, 20-50 parts of anhydrous ethanol, 2-4 parts of sodium hydroxide, and 15-30 parts of deionized water.

Optionally, the antibacterial agent is prepared by following steps.

Mixing nano zinc oxide and ammonium bicarbonate, adjusting a pH value of a resulting system to neutral, stirring at a rotating speed of 550-750 r/min for 25-45 min, heating to a temperature of 30-40° C., keeping at 30-40° C. for 10-30 min, cooling to room temperature to obtain a mixture, mixing the mixture and cobalt nitrate hexahydrate, dispersing in a part of anhydrous ethanol, adding diatomite and glacial acetic acid thereto, mixing, and subjecting a resulting mixture to reaction in a water bath at a temperature of 80-95° C. for 1-3 hours, to obtain a mixed solution.

Dissolving sodium hydroxide in a remaining anhydrous ethanol, magnetically stirring for 15-30 min, mixing a resulting alkali solution with the mixed solution, stirring for 25-35 min, subjecting a resulting mixture to reaction in a water bath at a temperature of 80-100° C. for 4-6 h, then adding deionized water thereto until a solution becomes into a milky white system, cooling to room temperature, magnetically stirring for 10-35 min, leaving a resulting system to stand, washing, and centrifuging, to obtain the antibacterial agent.

Optionally, in S7, during the heat-setting of two-stage drawing and one-stage relaxation: a first-stage drawing is performed at a temperature of 128-132° C. to a draw ratio of 4.1-4.3, a second-stage drawing is performed at a temperature of 185-195° C. to a draw ratio of 1.3-1.6, and the one-stage relaxation is performed at a temperature of 97-105° C. to a total relaxation ratio of 2.5-3.0%.

Optionally, in S4, the high-viscosity anti-ultraviolet modified polyester chip obtained in S2 is conveyed to a screw extruder, the antibacterial master batch obtained in S3 is added into the screw extruder through an online addition process, and melt-mixed together with the high-viscosity anti-ultraviolet modified polyester chip, and extruded to form a spinning melt, and the spinning melt is metered by means of a metering pump, filtered using a filtering system, then sprayed out through a spinneret, and cooled by side blowing, to form the tow.

Optionally, the high-viscosity anti-ultraviolet modified polyester chip has an intrinsic viscosity of 1.050-1.070 dl/g, temperatures of zones of the screw extruder are 292-302° C., 296-302° C., 293-300° C., 290-295° C., 287-293° C., and 287-293° C., the metering pump is operated at a rotational speed of 16-18 r/min, and a temperature of a slow cooling zone is in a range of 315-325° C.

Optionally, the spinneret is a different-filament spinneret.

Optionally, in S6: the first oiling is performed by an oil pulley, an oiling agent for the first oiling is GXM-100 spinning oiling agent, a first oiling agent pump has a rotating speed of 28-32 r/min, a second oiling agent pump has a rotating speed of 20-24 r/min, and an oil picking up is in a range of 0.5-0.8%.

Optionally, in S7, an oiling agent for the second oiling is a Gaussian oiling agent, an interlacing pressure is in a range of 0.35-0.45 MPa, a total oil picking up is in a range of 1.0-1.3%, and the winding forming is performed by a twin-roller winding machine at a winding speed of 2600-2800 m/min and a winding tension of 600-800 cN.

Optionally, the disclosure provide a polyester industrial yarn dedicated to a marine hawser, prepared by a method disclosed hereby.

In some embodiments, the disclosure provide a method for preparing a polyester industrial yarn dedicated to a marine hawser, including the following steps.

S1, preparing a regenerated polyester chip.

S2, blending the regenerated polyester chip obtained in S1 with an anti-ultraviolet agent, subjecting a resulting mixture to polymerization, granulating, and tackifying, to obtain a high-viscosity anti-ultraviolet modified polyester chip.

S3, mixing the regenerated polyester chip obtained in S1 with an antibacterial agent, and subjecting a resulting mixture to melt granulation, to obtain an antibacterial master batch.

S4, mixing the high-viscosity anti-ultraviolet modified polyester chip obtained in S2 and the antibacterial master batch obtained in S3, subjecting a resulting mixture to extruding and melting to form a spinning melt, metering, and spinning to form a tow.

S5, spraying a waterproof and acid- and alkali-resistant layer onto a surface of the tow obtained in S4.

S6, subjecting the tow obtained in S5 to first oiling.

S7, subjecting the tow obtained in S6 to heat-setting of two-stage drawing and one-stage relaxation, network processing, second oiling, and winding forming, to obtain the polyester industrial yarn dedicated to the marine hawser.

In the present disclosure, by the high-viscosity anti-ultraviolet modified polyester chip as a raw material, which is prepared by adding the anti-ultraviolet agent, the prepared polyester industrial yarn has great anti-ultraviolet and anti-aging performance, and the anti-ultraviolet performance is stable and long-lasting. Meanwhile, by the antibacterial master batch as a raw material, which is prepared by adding the antibacterial agent and mixing with the regenerated polyester chip, the prepared polyester industrial yarn has efficient antibacterial performance. In addition, the waterproof and acid- and alkali-resistant layer is sprayed onto the surface of the tow, so that the obtained polyester industrial yarn has good waterproof performance and acid- and alkali-resistance, improved corrosion resistance and wear resistance, and long-lasting waterproof performance. Therefore, in the synergistic effect of the anti-ultraviolet agent, the antibacterial agent, and the waterproof and acid- and alkali-resistant layer, the polyester industrial yarn dedicated to a marine hawser prepared by the method according to the present disclosure not only has high strength, good wear resistance, great anti-ultraviolet durability, but also has good antibacterial performance, corrosion resistance, and seawater resistance durability, thereby having a remarkably prolonged service life.

In some embodiments, in S5, raw materials for the waterproof and acid- and alkali-resistant layer include, in parts by weight, 30-45 parts of a waterborne polyurethane, 15-25 parts of a dispersant, 4-6 parts of silicon carbide, 10-20 parts of chitosan, 15-30 parts of sodium selenite, 5-6 parts of carbon nanotubes, 6-8 parts of titanium dioxide nanofibers, 20-35 parts of glycidyl ester epoxy resin, 3-10 parts of polytetramethylene ether glycol, 2-4 parts of butyl acrylate, 3-6 parts of polymaleic acid vinyl acid, 4-7 parts of dithiol succinate, 3-5 parts of polyurethane, 2-5 parts of dioctyl phthalate, 25-35 parts of deionized water, 10-15 parts of anhydrous ethanol, and 2-3 parts of acetic acid.

In some embodiments, the waterproof and acid- and alkali-resistant layer is prepared by a process including:

mixing silicon carbide and the dispersant, and ball milling a resulting mixture in a ball mill for 15-25 min, performing microwave heat treatment for 6-12 s, and taking out; adding a resulting product into the waterborne polyurethane, ultrasonically dispersing for 8-18 min, cooling at a temperature of 0-3° C. for 2-4 h, leaving to stand at a temperature of 85-95° C. for 3-5 h, filtering, drying a resulting solid at a temperature of 40-50° C., and ball milling to a particle size of 15-50 nm, to obtain a modified silicon carbide;

dissolving sodium selenite in deionized water to obtain a sodium selenite solution with a concentration of 15-35 mg/L, adding chitosan into the sodium selenite solution, uniformly mixing, heating a resulting mixture to a temperature of 50-60° C., uniformly stirring, subjecting a resulting mixture to rotatory evaporation under vacuum at a temperature of 55-60° C., performing ultraviolet intermittent irradiation, then performing heat preservation for 30-45 min, and freeze-drying, to obtain a modified chitosan;

mixing the carbon nanotubes and the modified chitosan, adding deionized water, ultrasonically dispersing for 10-15 min, adding titanium dioxide nanofibers, the modified silicon carbide and acetic acid thereto, uniformly mixing, adding glycidyl ester epoxy resin and anhydrous ethanol thereto, heating to a temperature of 40-60° C., keeping at 40-60° C. while stirring for 30-45 min, and defoaming to obtain a mixed stock solution; and uniformly mixing polytetramethylene ether glycol, butyl acrylate, polymaleic acid vinyl acid, dithiol succinate, polyurethane and dioctyl phthalate, heating to a temperature of 110-130° C., keeping at 110-130° C. for 10-30 min, then adding waterborne polyurethane and the dispersant thereto, uniformly mixing, further heating to a temperature of 150-180° C., keeping at 150-180° C. for 30-50 min, cooling to room temperature; and adding the mixed stock solution thereto, uniformly mixing, heating to a temperature of 80-90° C., keeping at 80-90° C. for 1-3 h, stirring at a rotating speed of 1500-2500 r/min for 20-40 min, cooling to room temperature, and spraying onto the surface of the tow.

In some embodiments, in S2, a mass ratio of the anti-ultraviolet agent to the regenerated polyester chip is in a range of (1-5):(95-99). Raw materials for the anti-ultraviolet agent include, in parts by weight, 10-20 parts of polypropylene resin, 5-7 parts of carbon nanotubes, 2-6 parts of nano titanium dioxide, 4-8 parts of nano zinc oxide, 5-7 parts of polyphenylene sulfide, 2-6 parts of butyl acrylate, 2-3 parts of zinc sulfate, 0.5-3 parts of attapulgite clay, 1-2 parts of diatomite, 1-3 parts of sodium α-olefin sulfonate, 1-2 parts of dibutyltin laurate, 1-2 parts of ammonium triphosphate, 1-2 parts of acrylamide, 1-4 parts of silane coupling agent KH-550, 20-35 parts of water, 1-3 parts of glycerol diacetate, and 2-5 parts of N,N-methylenebis(acrylamide).

In some embodiments, in S3, a mass ratio of the regenerated polyester chip to the antibacterial agent is in a range of (59.5-69.5):(30.5-40.5). Raw materials for the antibacterial agent include, in parts by weight, 15-25 parts of nano zinc oxide, 7-15 parts of diatomite, 3-6 parts of cobalt nitrate hexahydrate, 2-6 parts of ammonium bicarbonate, 2-4 parts of glacial acetic acid, 20-50 parts of anhydrous ethanol, 2-4 parts of sodium hydroxide, and 15-30 parts of deionized water.

In some embodiments, the antibacterial agent is prepared by a process including uniformly mixing nano zinc oxide and ammonium bicarbonate, adjusting a pH value of a resulting system to neutral, stirring at a rotating speed of 550-750 r/min for 25-45 min, heating to a temperature of 30-40° C., keeping at 30-40° C. for 10-30 min, cooling to room temperature to obtain a mixture, mixing the mixture and cobalt nitrate hexahydrate, dispersing in anhydrous ethanol, adding diatomite and glacial acetic acid thereto, uniformly mixing, and subjecting a resulting mixture to reaction in a water bath at a temperature of 80-95° C. for 1-3 hours, to obtain a mixed solution; and dissolving sodium hydroxide in anhydrous ethanol, magnetically stirring for 15-30 min, uniformly mixing a resulting alkali solution with the mixed solution, stirring for 25-35 min, subjecting a resulting mixture to reaction in a water bath at a temperature of 80-100° C. for 4-6 h, then adding deionized water thereto until a solution becomes into a milky white system, cooling to room temperature, magnetically stirring for 10-35 min, leaving to stand, washing, and centrifuging, to obtain the antibacterial agent.

In some embodiments, in S7, the heat-setting of two-stage drawing and one-stage relaxation is adopted, the first-stage drawing is performed at a temperature of 128-132° C. to a draw ratio of 4.1-4.3;

the second-stage drawing is performed at a temperature of 185-195° C. to a draw ratio of 1.3-1.6; and the one-stage relaxation is performed at a temperature of 97-105° C. to a total relaxation ratio of 2.5-3.0%.

In some embodiments, in S4, the high-viscosity anti-ultraviolet modified polyester chip obtained in S2 is conveyed to a screw extruder; the antibacterial master batch obtained in S3 is added into the screw extruder through an online addition process, and melt-mixed together with the high-viscosity anti-ultraviolet modified polyester chip, and extruded to form a spinning melt; and the spinning melt is metered by means of a metering pump, filtered using a filtering system, then sprayed out through a spinneret, and cooled by side blowing, to form the tow. The high-viscosity anti-ultraviolet modified polyester chip has an intrinsic viscosity of 1.050-1.070 dl/g; temperatures of zones of the screw extruder are 292-302° C., 296-302° C., 293-300° C., 290-295° C., 287-293° C., and 287-293° C., respectively; the metering pump is operated at a rotational speed of 16-18 r/min; and a temperature of a slow cooling zone is in a range of 315-325° C.

In some embodiments, in S6, the first oiling is performed by an oil pulley. An oiling agent used for the first oiling is Matsumoto GXM-100 spinning oiling agent; and a first oiling agent pump has a rotating speed of 28-32 r/min; a second oiling agent pump has a rotating speed of 20-24 r/min; and an oil picking up is in a range of 0.5-0.8%. In some embodiments, in S7, an oiling agent used for the second oiling is a Gaussian oiling agent, an interlacing pressure is in a range of 0.35-0.45 MPa, and a total oil picking up is in a range of 1.0-1.3%; and the winding is performed using a twin-roller winding machine, at a winding speed of 2600-2800 m/min, and a winding tension of 600-800 cN.

In addition, the present disclosure further provides a polyester industrial yarn dedicated to a marine hawser, which is prepared by the method for preparing the polyester industrial yarn dedicated to a marine hawser.

DETAILED DESCRIPTION

The following describes some non-limiting exemplary embodiments of the invention with reference to the accompanying drawings. The described embodiments are merely a part rather than all of the embodiments of the invention. All other embodiments obtained by a person of ordinary skill in the art based on the embodiments of the disclosure shall fall within the scope of the disclosure.

In order to further understand the content of the present disclosure, the technical solutions in embodiments of the present disclosure will be clearly and completely described below in conjunction with embodiments of the present disclosure. Obviously, the embodiments are part of embodiments of the present disclosure, not all of them. All other embodiments obtained by a person of ordinary skill in the art based on embodiments of the present disclosure without creative labor shall fall within the scope of the present disclosure.

It should be noted that, raw materials involved in the present disclosure could be purchased from the market. The Matsumoto GXM-100 spinning oiling agent and the Gaussian oiling agent are both existing reagents and are purchased from the market.

The present disclosure provides a method for preparing a polyester industrial yarn dedicated to a marine hawser, including the following steps:

S1: a regenerated polyester chip is prepared. The regenerated polyester chip is a polyester bottle chip. In some embodiments, the waste polyester is recovered, and automatic control cleaning technology is adopted; firstly, the recovered waste polyester is placed into a washing device and subjected to first washing, to mainly remove various non-polyester substances such as label paper, bottle caps, impurities on the polyester bottle; and qualified products are manually screened from the polyester bottle washed through the first washing, and then subjected to crushing, second washing, rinsing, dehydrating, and drying, to obtain the regenerated polyester bottle chip.

S2: the regenerated polyester chip obtained in S1 is blended with an anti-ultraviolet agent, and a resulting mixture is subjected to polymerization; a resulting product is granulated, and tackified by a vertical tackifying reactor, to obtain a high-viscosity anti-ultraviolet modified polyester chip. A mass ratio of the anti-ultraviolet agent to the regenerated polyester chip is in a range of (1-5):(95-99); and raw materials for the anti-ultraviolet agent include: in parts by weight, 10-20 parts of polypropylene resin, 5-7 parts of carbon nanotubes, 2-6 parts of nano titanium dioxide, 4-8 parts of nano zinc oxide, 5-7 parts of polyphenylene sulfide, 2-6 parts of butyl acrylate, 2-3 parts of zinc sulfate, 0.5-3 parts of attapulgite clay, 1-2 parts of diatomite, 1-3 parts of sodium α-olefin sulfonate, 1-2 parts of dibutyltin laurate, 1-2 parts of ammonium triphosphate, 1-2 parts of acrylamide, 1-4 parts of silane coupling agent KH-550, 20-35 parts of water, 1-3 parts of glycerol diacetate, and 2-5 parts of N,N-methylenebis(acrylamide). In some embodiments, the vertical tackifying reactor may include four sections, namely, crystallizer, reactor, finished product conveying section, and nitrogen purification section; the inlet temperature of the crystallizer is in a range of 175-180° C., the internal temperature of the reactor is in a range of 175-225° C., the outlet temperature of the reactor is in a range of 150-155° C., the temperature of the finished product conveying section is in a range of 35-37° C., the pressure of the nitrogen purification section is in a range of 30-32 kPa, and a time for the tackifying reaction is 70-80 h.

In specific embodiments, the anti-ultraviolet agent is prepared by a process including/being as follows: uniformly mixing polypropylene resin, polyphenylene sulfide, butyl acrylate, and nano zinc oxide, stirring at a temperature of 85-100° C. for 18-25 h, and cooling to room temperature, to obtain a first material; uniformly mixing carbon nanotubes, nano titanium dioxide, zinc sulfate, attapulgite clay, diatomite, sodium α-olefin sulfonate, dibutyltin laurate, ammonium tripolyphosphate, acrylamide, and water, heating to a temperature of 85-115° C., keeping at 85-115° C. for 2-6 hours, adding N,N-methylenebis(acrylamide) and glycerol diacetate thereto, uniformly mixing, cooling to a temperature of 35-60° C., filtering, washing, drying at a temperature of 90-120° C. for 2-7 hours, cooling to room temperature, to obtain a second material; uniformly mixing the first material, the second material, and the silane coupling agent KH-550, heating to 85-95° C., keeping at 85-95° C. for 15-25 min, stirring at a rotational speed of 600-900 r/min for 10-20 min, and then cooling to room temperature, to obtain the anti-ultraviolet agent.

In the anti-ultraviolet agent prepared in the present disclosure, the polypropylene resin acts as a base resin, nano zinc oxide, nano titanium dioxide, zinc nitrate, attapulgite clay, and diatomite act as an anti-ultraviolet reinforcing filler system. The anti-ultraviolet reinforcing filler system contains zinc elements and titanium elements, each in a great amount. Meanwhile, zinc elements and titanium elements are present in a great amount such that in the effect of porous adsorption of carbon nanotubes, an oxide film formed from the zinc elements and titanium elements fills interspaces of carbon nanotubes, thereby forming a dense oxide film on a surface of polyester industrial yarn(s). When ultraviolet rays of sunlight irradiate the surface of the polyester industrial yarn(s), due to the absorption effect of ultraviolet rays by the zinc elements and the titanium elements, the damage of the ultraviolet rays to the polyester industrial yarn(s) is greatly reduced, which significantly improves anti-ultraviolet performance of the polyester industrial yarn(s), and thereby prolongs the service life of the polyester industrial yarn(s). Moreover, the surface hydroxyl groups of the anti-ultraviolet reinforcing filler system are modified by grafting with the silane coupling agent KH-550, which achieves the bonding of the anti-ultraviolet reinforcing filler system and the base resin, and improves the stability of the anti-ultraviolet performance thereof, thereby resulting in long-lasting anti-ultraviolet performance. Therefore, the anti-ultraviolet and anti-aging performance of polyester yarn(s) and marine hawser is effectively improved, thereby prolonging the service life thereof.

S3: the regenerated polyester chip obtained in S1 is mixed with an antibacterial agent, and a resulting mixture is subjected to melt granulation, to obtain an antibacterial master batch. A mass ratio of the regenerated polyester chip to the antibacterial agent is in a range of (59.5-69.5):(30.5-40.5); and raw materials for the antibacterial agent include, in parts by weight, 15-25 parts of nano zinc oxide, 7-15 parts of diatomite, 3-6 parts of cobalt nitrate hexahydrate, 2-6 parts of ammonium bicarbonate, 2-4 parts of glacial acetic acid, 20-50 parts of anhydrous ethanol, 2-6 parts of silver nitrate, 2-4 parts of sodium hydroxide, and 15-30 parts of deionized water.

In specific embodiments, the antibacterial agent is prepared by a process including/being as follows:

uniformly mixing nano zinc oxide and ammonium bicarbonate, adjusting a pH value of a resulting system to neutral, stirring at a rotating speed of 550-750 r/min for 25-45 min, heating to a temperature of 30-40° C., keeping at 30-40° C. for 10-30 min, cooling to room temperature to obtain a mixture; mixing the mixture and cobalt nitrate hexahydrate, and dispersing in anhydrous ethanol, adding diatomite and glacial acetic acid thereto, uniformly mixing, and subjecting a resulting mixture to reaction in a water bath at a temperature of 80-95° C. for 1-3 hours, to obtain a mixed solution; dissolving sodium hydroxide in anhydrous ethanol, magnetically stirring for 15-30 min, uniformly mixing a resulting alkali solution with the mixed solution, stirring for 25-35 min, subjecting a resulting mixture to reaction in a water bath at a temperature of 80-100° C. for 4-6 h, then adding deionized water thereto until a solution becomes into a milky white system, cooling to room temperature, magnetically stirring for 10-35 min, leaving a resulting system to stand, washing, and centrifuging, to obtain the antibacterial agent.

In the antibacterial agent, diatomite acts as a support, cobalt nitrate hexahydrate acts as a dopant, the nano zinc oxide quantum dots act as main antibacterial components; the zinc oxide quantum dots, due to their size limitation and the quantum confinement effect, in combination with their coupling with $Co^{2+}$, could effectively inhibit the recombination of photo-generated electrons and holes on the surface of the zinc oxide; Co-doped zinc oxide quantum dots are loaded on the surface of the diatomite; and in the effect of acetic acid, in the diatomite, the oxide impurity content is reduced, the $SiO_2$ content is increased, and the specific surface area and pore volume are also increased, so that the diatomite has a huge specific surface area and a high absorptivity, resulting in bacteria absorbed on the surface thereof. Therefore, there is a synergistic effect together with the Co-doped zinc oxide quantum dots loaded on the surface of the diatomite and in the pores, in terms of efficient antibacterial effect, thereby killing the bacteria. Also, in the diatomite crystal lattice, isomorphous replacement easily occurs between $Si^{4+}$ ions and other low-valence cations, so that bacteria are adsorbed, resulting in improved antibacterial performance. Therefore, the polyester industrial yarn prepared using the antibacterial agent in the present disclosure has efficient antibacterial performance and a long-acting bacteriostasis, thereby prolonging the service life of the polyester industrial yarn.

S4, the high-viscosity anti-ultraviolet modified polyester chip obtained in S2 is conveyed to a screw extruder, and the antibacterial master batch obtained in S3 is added into the screw extruder through an online addition process, melt-mixed together with the high-viscosity anti-ultraviolet modified polyester chip, and extruded to form a spinning melt. The spinning melt is metered by means of a metering pump, filtered using a filtering system, then sprayed out through a spinneret, and cooled by side blowing. The high-viscosity anti-ultraviolet modified polyester chip has an intrinsic viscosity of 1.050-1.070 dl/g; the use of the high-viscosity anti-ultraviolet polyester chip with defined viscosity results in that the prepared polyester industrial yarn not only has a great strength, but also is more uniform and stable in quality; temperatures of zones of the screw extruder are 292-302° C., 296-302° C., 293-300° C., 290-295° C., 287-293° C., and 287-293° C., respectively; the metering pump is operated at a rotational speed of 16-18 r/min; and a temperature of a slow cooling zone is in a range of 315-325° C.; by defining the parameters as discussed above, the spinning quality could be ensured and meanwhile the production efficiency of spinning could be improved. In addition, the addition of the antibacterial master batch into the screw through an online addition process for melting together with the high-viscosity anti-ultraviolet modified polyester chip is more environmentally-friendly and saves energy consumption.

In practical embodiments, the spinneret is a different-filament spinneret, and the different-filament spinneret belongs to the prior art, please refer to the different-filament spinneret and a method for producing high-strength low-elongation industrial yarn for high-wear-resistance marine hawser disclosed in CN201610797955.3. By the different-filament spinneret, the industrial yarn produced has an outer layer of an irregular fibril, and an inner layer of a regular fibril, the irregular fibril encapsulating all the regular fibrils, so that the regular fibrils could not be exposed; the irregular fibril has a denier larger than that of the regular fibril, and thereby exhibits greater wear resistance, so that the overall wear resistance of the marine hawser is improved.

S5, a waterproof and acid- and alkali-resistant layer is sprayed onto a surface of the tow obtained in S4. In some embodiments, raw materials for the waterproof and acid- and alkali-resistant layer include, in parts by weight, 30-45 parts of a waterborne polyurethane, 15-25 parts of a dispersant, 4-6 parts of silicon carbide, 10-20 parts of chitosan, 15-30 parts of sodium selenite, 5-6 parts of carbon nanotubes, 6-8 parts of titanium dioxide nanofibers, 20-35 parts of glycidyl ester epoxy resin, 3-10 parts of polytetramethylene ether glycol, 2-4 parts of butyl acrylate, 3-6 parts of polymaleic acid vinyl acid, 4-7 parts of dithiol succinate, 3-5 parts of polyurethane, 2-5 parts of dioctyl phthalate, 25-35 parts of deionized water, 10-15 parts of anhydrous ethanol, and 2-3 parts of acetic acid. The dispersant is sodium alginate.

In specific embodiments, the waterproof and acid- and alkali-resistant layer is prepared by a process including/being as follows:

mixing silicon carbide and the dispersant, and ball milling a resulting mixture in a ball mill for 15-25 min, performing microwave heat treatment for 6-12 s, and taking out; adding a resulting product into the waterborne polyurethane, ultrasonically dispersing for 8-18 min, cooling at a temperature of 0-3° C. for 2-4 h, leaving to stand at a temperature of 85-95° C. for 3-5 h, filtering, drying a resulting solid at a temperature of 40-50° C., and ball milling to a particle size of 15-50 nm, to obtain a modified silicon carbide; dissolving sodium selenite in deionized water to obtain a sodium selenite solution with a concentration of 15-35 mg/L, adding chitosan into the sodium selenite solution, uniformly mixing, heating a resulting mixture to a temperature of 50-60° C., uniformly stirring, subjecting a resulting mixture to rotatory evaporation under vacuum at a temperature of 55-60° C., performing ultraviolet intermittent irradiation (during which an ultraviolet irradiation is performed under an irradiation intensity of 2000-2400 $\mu W/cm^2$ for an irradiation time of 4-12 min, and then the ultraviolet irradiation is stopped for 8-20 min), then performing heat preservation for 30-45 min, and freeze-drying, to obtain a modified chitosan; mixing the carbon nanotubes and the modified chitosan, adding deionized water thereto, ultrasonically dispersing for 10-15 min, adding titanium dioxide nanofibers, the modified silicon carbide, and acetic acid thereto, uniformly mixing, adding glycidyl ester epoxy resin and anhydrous ethanol thereto, heating a resulting mixture to a temperature of 40-60° C., keeping at 40-60° C. while stirring for 30-45 min, and defoaming to obtain a mixed stock solution; uniformly mixing polytetramethylene ether glycol, butyl acrylate, polymaleic acid vinyl acid, dithiol succinate, polyurethane, and dioctyl phthalate, heating a resulting mixture to a temperature of 110-130° C., keeping at 110-130° C. for 10-30 min, then adding the waterborne polyurethane and the dispersant thereto, uniformly mixing, further heating to a temperature of 150-180° C., keeping at 150-180° C. for 30-50 min, cooling to room temperature; and adding the mixed stock solution thereto, uniformly mixing, heating to a temperature of 80-90° C., keeping at 80-90° C. for 1-3 h, stirring at a rotating speed of 1500-2500 r/min for 20-40 min, cooling to room temperature, and spraying onto the surface of the tow.

In the waterproof and acid- and alkali-resistant layer, the silicon carbide is modified by the polyurethane, so that the dispersion of the silicon carbide is enhanced, and the interface fusion of the waterproof and acid- and alkali-resistant layer and the substrate is thereby promoted, resulting in enhanced mechanical properties of the polyester industrial yarn. Moreover, the presence of the polyurethane modified silicon carbide could block the invasion of acid and alkali molecules, thereby improving acid- and alkali-resistance of the polyester industrial yarn. Meanwhile, the use of titanium dioxide nanofibers could increase the specific surface area of titanium dioxide, and meanwhile plays a hydrophobic role on the surface of the polyester industrial yarn, thereby preventing the erosion of rainwater on the polyester industrial yarn in rainy days. In addition, the use of the modified chitosan could improve the bonding of chitosan amino and selenium, improve the stability of the modified chitosan, improve the flexibility and cohesiveness of the chitosan, and significantly improve the mixing and dispersing effect of chitosan and carbon nanotubes, and the bonding strength therebetween, resulting in improved corrosion resistance and strength of fibers, and thereby improved corrosion resistance and structural strength of the polyester industrial yarn. The chitosan could be easily dissolved in a weak acid solvent, the dissolved solution contains amino groups; the amino groups combine with bacteria by combining negatively-charged electrons, so that the bacteria undergo structure change or energy transfer, which causes the bacteria to die, thereby achieving the bacteriostatic effect. The permeation effect of the waterborne polyurethane, together with the role of polytetramethylene ether glycol, butyl acrylate, polymaleic acid vinyl acid, dithioglycol succinic acid, polyurethane, dioctyl phthalate as an anti-wrinkle hot melt adhesive, results in a firm attachment to the surface of the polyester industrial yarn, to prevent the falling off of the waterproof and acid- and alkali-resistant layer. Therefore, the durability of waterproof performance and acid- and alkali-resistance of the polyester industrial yarn is effectively improved, thereby prolonging the service life of the polyester industrial yarn.

S6, first oiling is performed with Matsumoto GXM-100 spinning oiling agent on the tow obtained in S5 by an oil pulley. A first oiling agent pump has a rotating speed of 28-32 r/min; a second oiling agent pump has a rotating speed of 20-24 r/min; and an oil picking up is in a range of 0.5-0.8%. These parameters defined ensure the uniformity of the oiling on the surface of the tow.

S7: the tow obtained in S6 is subjected to heat-setting of two-stage drawing and one-stage relaxation, then network processing, second oiling, and winding forming, to obtain the polyester industrial yarn dedicated to the marine hawser. The first-stage drawing is performed at a temperature of 128-132° C. to a draw ratio of 4.1-4.3; the second-stage drawing is performed at a temperature of 185-195° C. to a draw ratio of 1.3-1.6; and the one-stage relaxation is performed at a temperature of 97-105° C. to a total relaxation ratio of 2.5-3.0%; an oiling agent used for the second oiling is a Gaussian oiling agent, an interlacing pressure is in a range of 0.35-0.45 MPa, and a total oil picking up is in a range of 1.0-1.3%; and the winding is performed using a twin-roller winding machine, at a winding speed of 2600-2800 m/min, and a winding tension of 600-800 cN. In this step, the second oiling is adopted to improve the antistatic effect of the polyester industrial yarn, and further to improve the seawater-repellent and great wear resistance of the polyester industrial yarn and the marine hawser. The process parameters of interlacing pressure, winding speed, and winding tension as defined above improve production efficiency of the polyester industrial yarn while ensuring the quality of the polyester industrial yarn.

In conclusion, in the present disclosure, by the high-viscosity anti-ultraviolet modified polyester chip as a raw material, which is prepared by adding the anti-ultraviolet agent, the prepared polyester industrial yarn has great anti-ultraviolet and anti-aging performance, and the anti-ultraviolet performance is stable and long-lasting. Meanwhile, by the antibacterial master batch as a raw material, which is prepared by adding the antibacterial agent and mixing with the regenerated polyester chip, the prepared polyester industrial yarn has efficient antibacterial performance. In addition, by spraying the waterproof and acid- and alkali-resistant layer onto the surface of the tow, the obtained polyester industrial yarn has good waterproof performance and acid- and alkali-resistance, improved corrosion resistance and wear resistance, and long-lasting waterproof performance. Therefore, in the synergistic effect of the anti-ultraviolet agent, the antibacterial agent, and the waterproof and acid- and alkali-resistant layer, the polyester industrial yarn dedicated to a marine hawser prepared by the method according to the present disclosure not only has high strength, good wear resistance, great anti-ultraviolet durability, but also has good antibacterial performance, corrosion resistance, and seawater resistance durability, thereby having a remarkably prolonged service life.

In addition, the present disclosure further provides a polyester industrial yarn dedicated to a marine hawser, which is prepared by the method for preparing the polyester industrial yarn dedicated to a marine hawser as described above.

Example 1

Preparation of Regenerated Polyester Bottle Chip

The waste polyester was recovered, and an automatic control cleaning technology was adopted. The recovered waste polyester was placed into a washing device and subjected to first washing, to mainly remove various non-polyester substances such as label paper, bottle caps, impurities on the polyester bottle. Qualified products were manually screened from the polyester bottle washed through the first washing, then crushed, and subjected to second washing, rinsing, dehydrating, and drying, to obtain the regenerated polyester bottle chip.

Preparation of an Anti-Ultraviolet Agent, an Anti-Bacterial Agent and a Waterproof and Acid- and Alkali-Resistant Slurry Raw materials for the anti-ultraviolet agent consisted of: in parts by weight, 10 parts of polypropylene resin, 5 parts of carbon nanotubes, 2 parts of nano titanium dioxide, 4 parts of nano zinc oxide, 5 parts of polyphenylene sulfide, 2 parts of butyl acrylate, 2 parts of zinc sulfate, 0.5 part of attapulgite clay, 1 part of diatomite, 1 part of sodium α-olefin sulfonate, 1 part of dibutyltin laurate, 1 part of ammonium triphosphate, 1 part of acrylamide, 1 part of silane coupling agent KH-550, 25 parts of water, 1 part of glycerol diacetate, and 2 parts of N,N-methylenebis(acrylamide).

10 Parts by weight of polypropylene resin, 5 parts by weight of polyphenylene sulfide, 2 parts by weight of butyl acrylate, and 4 parts by weight of nano zinc oxide were uniformly mixed, and a resulting mixture was stirred at 85° C. for 23 h, and cooled to room temperature to obtain a first material. 5 Parts by weight of carbon nanotubes, 2 parts by weight of nano titanium dioxide, 2 parts by weight of zinc sulfate, 0.5 part by weight of attapulgite clay, 1 part by weight of diatomite, 1 part by weight of sodium α-olefin sulfonate, 1 part by weight of dibutyltin laurate, 1 part by weight of ammonium tripolyphosphate, 1 part by weight of acrylamide, and 25 parts by weight of water were uniformly mixed, and a resulting mixture was heated to 85° C., and kept at 85° C. for 5 hours. 2 Parts by weight of N,N-methylenebis(acrylamide) and 1 part by weight of glycerol diacetate were added thereto, and they were uniformly mixed; a resulting mixture was cooled to 35° C., filtered, followed by washing; and the obtained product was dried at 90° C. for 7 hours, and then cooled to room temperature to obtain a second material. The first material, the second material, and 1 part by weight of the silane coupling agent KH-550 were uniformly mixed; a resulting mixture was heated to 85° C., kept at 85° C. for 25 min, stirred at a rotational speed of 600 r/min for 20 min, and then cooled to room temperature, to obtain the anti-ultraviolet agent.

Raw materials for the antibacterial agent consisted of: in parts by weight, 15 parts of nano zinc oxide, 7 parts of diatomite, 3 parts of cobalt nitrate hexahydrate, 2 parts of ammonium bicarbonate, 2 parts of glacial acetic acid, 25 parts of anhydrous ethanol, 2 parts of silver nitrate, 2 parts of sodium hydroxide, and 15 parts of deionized water.

15 parts by weight of nano zinc oxide and 2 parts by weight of ammonium bicarbonate were uniformly mixed, and the pH value of a resulting mixture was then adjusted to be neutral; a resulting system was stirred at 550 r/min for 40 min, then heated to 30° C., kept at 30° C. for 10 min, and then cooled to room temperature to obtain a mixture. The mixture and 3 parts by weight of cobalt nitrate hexahydrate were mixed and dispersed in 20 parts by weight of anhydrous ethanol, and 7 parts by weight of diatomite and 2 parts by weight of glacial acetic acid were then added thereto. A resulting mixture was uniformly mixed, heated and subjected to reaction in a water bath at 80° C. for 3 h, to obtain a mixed solution. 2 Parts by weight of sodium hydroxide was dissolved in 5 parts by weight of anhydrous ethanol, followed by magnetically stirring for 15 min; a resulting alkali solution and the mixed solution obtained above were uniformly mixed, and stirred for 25 min. A resulting mixture was heated and subjected to reaction in a water bath at 90° C. for 6 h, and 15 parts by weight of deionized water was then added until the solution became into a milky white system. The resulting system was cooled to room temperature, magnetically stirred for 10 min, left to stand, and subjected to washing, and centrifuging, to obtain the antibacterial agent.

Raw materials for the waterproof and acid- and alkali-resistant layer consisted of: in parts by weight, 30 parts of a waterborne polyurethane, 15 parts of sodium alginate, 4 parts of silicon carbide, 10 parts of chitosan, 15 parts of sodium selenite, 5 parts of carbon nanotubes, 6 parts of titanium dioxide nanofibers, 20 parts of glycidyl ester epoxy resin, 3 parts of polytetramethylene ether glycol, 2 parts of butyl acrylate, 3 parts of polymaleic acid vinyl acid, 4 parts of dithiol succinate, 3 parts of polyurethane, 2 parts of dioctyl phthalate, 25 parts of deionized water, 10 parts of anhydrous ethanol, and 2 parts of acetic acid.

4 Parts by weight of silicon carbide and 10 parts by weight of sodium alginate were mixed, and a resulting mixture was ball milled in a ball mill for 15 min, then subjected to microwave heat treatment for 6 s, then taken out, and added to 20 parts by weight of waterborne polyurethane. A resulting mixture was ultrasonically dispersed for 8 min, cooled at 0° C. for 2 h, left to stand at 85° C. for 3 h, and filtered, followed by drying at 40° C., and ball-milled until the particle size was 15 nm, to obtain the modified silicon carbide. 15 Parts by weight of sodium selenite was dissolved in 10 parts by weight of deionized water, to obtain a sodium selenite solution with a concentration of 15 mg/L. 10 Parts by weight of chitosan was added to the sodium selenite solution, and a resulting mixture was uniformly mixed, heated to 50° C., followed by uniformly stirring. A resulting mixture was subjected to rotatory evaporation under vacuum at a temperature of 55° C., and irradiated under ultraviolet rays of 2000 $\mu W/cm^2$ for 12 min, and the irradiation was then stopped for 20 min. The resulting mixture was subjected to heat preservation for 30 min, and freeze-dried, to obtain the modified chitosan. 5 Parts by weight of carbon nanotubes and modified chitosan were mixed, 15 parts by weight of deionized water was then added thereto, and a resulting mixture was ultrasonically dispersed for 10 min. 6 Parts by weight of titanium dioxide nanofibers, the modified silicon carbide, and 2 parts by weight of acetic acid were uniformly mixed, and 20 parts by weight of glycidyl ester epoxy resin and 10 parts by weight of anhydrous ethanol were added thereto. A resulting mixture was heated to 40° C., kept at 40° C. while stirring for 30 minutes, and defoamed, to obtain a mixed stock solution. 3 Parts by weight of polytetramethylene ether glycol, 2 parts by weight of butyl acrylate, 3 parts by weight of polymaleic acid vinyl acid, 4 parts by weight of dithiol succinate, 3 parts by weight of polyurethane, and 2 parts by weight of dioctyl phthalate were uniformly mixed, heated to 110° C., and kept at 110° C. for 10 min. 10 Parts by weight of the waterborne polyurethane and 5 parts by weight of sodium alginate were added thereto, and a resulting mixture was further heated to 150° C., kept at 150° C. for 30 min, and then cooled to room temperature. The mixed stock solution was then added thereto, and a resulting mixture was uniformly mixed, heated to 80° C., kept at 80° C. for 1 h, stirred at a rotational speed of 1500 r/min for 40 min, and cooled to room temperature, to obtain the waterproof and acid-resistant alkali-resistant slurry.

The prepared anti-ultraviolet agent and regenerated polyester bottle chip were blended in a mass ratio of 1:99, and polymerized into an anti-ultraviolet modified polyester chip, by means of a melt-free plastic granulation system. The obtained anti-ultraviolet modified polyester chip was tackified by a vertical tackifying reactor, to obtain a high-viscosity anti-ultraviolet modified polyester chip having an intrinsic viscosity of 1.050 dl/g. The vertical tackifying reactor had four sections, namely, crystallizer, reactor, finished product conveying section, and nitrogen purification section; the inlet temperature of the crystallizer was 175° C., the internal temperature of the reactor was 180° C., the outlet temperature of the reactor was 150° C., the temperature of the finished product conveying section was 35° C., the pressure of the nitrogen purification section was 30 kPa, and a time for the tackifying reaction was 70 h.

The regenerated polyester bottle chip and the antibacterial agent were mixed in a mass ratio of 69.5:30.5, and a resulting mixture was subjected to melt granulation, to obtain the antibacterial master batch.

The obtained high-viscosity anti-ultraviolet modified polyester chip was conveyed to a screw extruder; the antibacterial master batch obtained above was added into the screw extruder through an online addition process, and melt-mixed together with the high-viscosity anti-ultraviolet modified polyester chip, to form a spinning melt. The spinning melt was metered by means of a metering pump, filtered using a filtering system, then sprayed out through a spinneret, and cooled by side blowing to form a tow. The spinneret was a different-filament spinneret; temperature of zones of the screw rod were 292° C., 296° C., 293° C., 290° C., 287° C., 287° C., respectively; the metering pump was operated at a rotational speed of 16 r/min; and a temperature of a slow cooling zone was 315° C.

The prepared waterproof acid-resistant and alkali-resistant slurry was sprayed onto the surface of the tow obtained above to form a waterproof and acid-resistant and alkali-resistant layer; by an oil pulley, the first oiling was performed with Matsumoto GXM-100 spinning oiling agent on the tow with the waterproof and acid-resistant and alkali-resistant layer sprayed thereon; and a first oiling agent pump had a rotating speed of 28 r/min; a second oiling agent pump had a rotating speed of 20 r/min; and an oil picking up was 0.5%.

The tow after the first oiling was subjected to heat-setting of two-stage drawing and one-stage relaxation. The first-stage drawing was performed at a temperature of 128° C. to a draw ratio of 4.1; the second-stage drawing was performed at a temperature of 185° C. to a draw ratio of 1.3; and the one-stage relaxation was performed at a temperature of 97° C. to a total relaxation ratio of 2.5%.

The fibers after the heat-setting of drawing were subjected to network processing, and then second oiling with a Gaussian oiling agent. The interlacing pressure was 0.35 MPa, and the total oil picking up was 1.0%.

The tows after the second oiling were wound and formed by a twin-roller winding machine at a winding speed of 2600 m/min and a winding tension of 600 cN, to obtain the regenerated polyester industrial yarn for the anti-ultraviolet marine hawser.

Example 2

Preparation of Regenerated Polyester Bottle Chip

The waste polyester was recovered, and an automatic control cleaning technology was adopted. The recovered waste polyester was placed into a washing device and subjected to first washing, to mainly remove various non-polyester substances such as label paper, bottle caps, impurities on the polyester bottle. Qualified products were manually screened from the polyester bottle washed through the first washing, then crushed, and subjected to second washing, rinsing, dehydrating, and drying, to obtain the regenerated polyester bottle chip.

Preparation of an Anti-Ultraviolet Agent, an Anti-Bacterial Agent and a Waterproof and Acid- and Alkali-Resistant Slurry Raw materials for the anti-ultraviolet agent consisted of: in parts by weight, 15 parts of polypropylene resin, 6 parts of carbon nanotubes, 4 parts of nano titanium dioxide, 6 parts of nano zinc oxide, 6 parts of polyphenylene sulfide, 4 parts of butyl acrylate, 2.5 parts of zinc sulfate, 1.5 parts of attapulgite clay, 1.5 parts of diatomite, 2 parts of sodium α-olefin sulfonate, 1.5 parts of dibutyltin laurate, 1.5 parts of ammonium triphosphate, 1.5 parts of acrylamide, 3 parts of silane coupling agent KH-550, 30 parts of water, 2 parts of glycerol diacetate, and 3 parts of N,N-methylenebis(acrylamide).

15 Parts by weight of polypropylene resin, 6 parts by weight of polyphenylene sulfide, 4 parts by weight of butyl acrylate, and 6 parts by weight of nano zinc oxide were uniformly mixed, and a resulting mixture was stirred at 90° C. for 20 h, and cooled to room temperature to obtain a first material. 6 Parts by weight of carbon nanotubes, 4 parts by weight of nano titanium dioxide, 2.5 parts by weight of zinc sulfate, 1.5 parts by weight of attapulgite clay, 1.5 parts by weight of diatomite, 2 parts by weight of sodium α-olefin sulfonate, 1.5 parts by weight of dibutyltin laurate, 1.5 parts by weight of ammonium tripolyphosphate, 1.5 parts by weight of acrylamide, and 30 parts by weight of water were uniformly mixed, and a resulting mixture was heated to 90° C., kept at 90° C. for 3 hours. 3 Parts by weight of N,N-methylenebis(acrylamide) and 2 parts by weight of glycerol diacetate were added thereto, and they were uniformly mixed; a resulting mixture was cooled to 45° C., filtered, followed by washing; and the obtained product was dried at 100° C. for 5 hours, and then cooled to room temperature to obtain a second material. The first material, the second material, and 3 parts by weight of the silane coupling agent KH-550 were uniformly mixed; a resulting mixture was heated to 90° C., kept at 90° C. for 20 min, stirred at a rotational speed of 800 r/min for 15 min, and then cooled to room temperature, to obtain the anti-ultraviolet agent.

Raw materials for the antibacterial agent consisted of: in parts by weight, 20 parts of nano zinc oxide, 12 parts of diatomite, 5 parts of cobalt nitrate hexahydrate, 4 parts of ammonium bicarbonate, 3 parts of glacial acetic acid, 35 parts of anhydrous ethanol, 4 parts of silver nitrate, 3 parts of sodium hydroxide, and 25 parts of deionized water.

20 parts by weight of nano zinc oxide and 4 parts by weight of ammonium bicarbonate were uniformly mixed, and the pH value of a resulting mixture was then adjusted to be neutral; a resulting system was stirred at 650 r/min for 35 min, then heated to 35° C., kept at 35° C. for 20 min, and then cooled to room temperature to obtain a mixture. The mixture and 5 parts by weight of cobalt nitrate hexahydrate were mixed and dispersed in 28 parts by weight of anhydrous ethanol, and 12 parts by weight of diatomite and 3 parts by weight of glacial acetic acid were then added thereto. A resulting mixture was uniformly mixed, heated and subjected to reaction in a water bath at 90° C. for 2 h, to obtain a mixed solution. 3 Parts by weight of sodium hydroxide was dissolved in 7 parts by weight of anhydrous ethanol, followed by magnetically stirring for 25 min; a resulting alkali solution and the mixed solution obtained above were uniformly mixed, and stirred for 30 min. A resulting mixture was heated and subjected to reaction in a water bath at 100° C. for 5 h, and 25 parts by weight of deionized water was then added thereto until the solution became into a milky white system. The resulting system was cooled to room temperature, magnetically stirred for 15 min, left to stand, and subjected to washing, and centrifuging, to obtain the antibacterial agent.

Raw materials for the waterproof and acid- and alkali-resistant layer consisted of: in parts by weight, 350 parts of a waterborne polyurethane, 20 parts of sodium alginate, 5 parts of silicon carbide, 15 parts of chitosan, 20 parts of sodium selenite, 5 parts of carbon nanotubes, 7 parts of titanium dioxide nanofibers, 25 parts of glycidyl ester epoxy resin, 6 parts of polytetramethylene ether glycol, 3 parts of butyl acrylate, 4 parts of polymaleic acid vinyl acid, 5 parts of dithiol succinate, 4 parts of polyurethane, 4 parts of dioctyl phthalate, 30 parts of deionized water, 12 parts of anhydrous ethanol, and 2 parts of acetic acid.

5 Parts by weight of silicon carbide and 15 parts by weight of sodium alginate were mixed, and a resulting mixture was ball milled in a ball mill for 20 min, then subjected to microwave heat treatment for 8 s, then taken out, and added to 20 parts by weight of the waterborne polyurethane. A resulting mixture was ultrasonically dispersed for 12 min, cooled at 2° C. for 3 h, left to stand at 90° C. for 4 h, and filtered, followed by drying at 45° C., and ball-milled until the particle size was 25 nm, to obtain the modified silicon carbide. 20 Parts by weight of sodium selenite was dissolved in 20 parts by weight of deionized water, to obtain a sodium selenite solution with a concentration of 25 mg/L. 15 Parts by weight of chitosan was added to the sodium selenite solution, and a resulting mixture was uniformly mixed, heated to 55° C., followed by uniformly stirring. A resulting mixture was subjected to rotatory evaporation under vacuum at a temperature of 58° C., and irradiated under ultraviolet rays of 2200 $\mu W/cm^2$ for 8 min, and the irradiation was then stopped for 16 min. The resulting mixture was subjected to heat preservation for 35 min, and freeze-dried, to obtain the modified chitosan. 5 Parts by weight of carbon nanotubes and modified chitosan were mixed, 10 parts by weight of deionized water was then added thereto, and a resulting mixture was ultrasonically dispersed for 12 min. 7 Parts by weight of titanium dioxide nanofibers, the modified silicon carbide, and 2 parts by weight of acetic acid were uniformly mixed, and 25 parts by weight of glycidyl ester epoxy resin and 12 parts by weight of anhydrous ethanol were added thereto. A resulting mixture was heated to 50° C., kept at 50° C. while stirring for 35 minutes, and defoamed, to obtain a mixed stock solution. 6 Parts by weight of polytetramethylene ether glycol, 3 parts by weight of butyl acrylate, 4 parts by weight of polymaleic acid vinyl acid, 5 parts by weight of dithiol succinate, 4 parts by weight of polyurethane, and 4 parts by weight of dioctyl phthalate were uniformly mixed, heated to 120° C., and kept at 120° C. for 20 min. 15 Parts by weight of waterborne polyurethane and 5 parts by weight of sodium alginate were added thereto, and a resulting mixture was further heated to 160° C., kept at 160° C. for 40 min, and then cooled to room temperature. The mixed stock solution was then added thereto, and a resulting mixture was uniformly mixed, heated to 85° C., kept at 85° C. for 2 h, stirred at a rotational speed of 2000 r/min for 30 min, and cooled to room temperature, to obtain the waterproof and acid-resistant alkali-resistant slurry.

The prepared anti-ultraviolet agent and regenerated polyester bottle chip were blended in a mass ratio of 3:97, and polymerized into an anti-ultraviolet modified polyester chip, by means of a melt-free plastic granulation system. The obtained anti-ultraviolet modified polyester chip was tackified by a vertical tackifying reactor, to obtain a high-viscosity anti-ultraviolet modified polyester chip having an intrinsic viscosity of 1.060 dl/g. The vertical tackifying reactor had four sections, namely, crystallizer, reactor, finished product conveying section, and nitrogen purification section; the inlet temperature of the crystallizer was 178° C., the internal temperature of the reactor was 175-225° C., the outlet temperature of the reactor was 153° C., the temperature of the finished product conveying section was 36° C., the pressure of the nitrogen purification section was 31 kPa, and a time for the tackifying reaction was 75 h.

The regenerated polyester bottle chip and the antibacterial agent were mixed in a mass ratio of 64.5:35.5, and a resulting mixture was subjected to melt granulation, to obtain the antibacterial master batch.

The obtained high-viscosity anti-ultraviolet modified polyester chip was conveyed to a screw extruder; the antibacterial master batch obtained above was added into the screw extruder through an online addition process, and melt-mixed together with the high-viscosity anti-ultraviolet modified polyester chip, to form a spinning melt. The spinning melt was metered by means of a metering pump, filtered using a filtering system, then sprayed out through a spinneret, and cooled by side blowing to form a tow. The spinneret was a different-filament spinneret; temperature of zones of the screw rod were 299° C., 297° C., 295° C., 292° C., 291° C., 289° C.; the metering pump was operated at a rotational speed of 17 r/min; and a temperature of a slow cooling zone was 320° C.

The prepared waterproof acid-resistant and alkali-resistant slurry was sprayed onto the surface of the tow obtained above to form a waterproof and acid-resistant and alkali-resistant layer; by an oil pulley, the first oiling was performed with Matsumoto GXM-100 spinning oiling agent on the tow with the waterproof and acid-resistant and alkali-resistant layer sprayed thereon; and a first oiling agent pump had a rotating speed of 30 r/min; a second oiling agent pump had a rotating speed of 22 r/min; and an oil picking up was 0.5%.

The tow after the first oiling was subjected to heat-setting of two-stage drawing and one-stage relaxation. The first-stage drawing was performed at a temperature of 130° C. to a draw ratio of 4.2; the second-stage drawing was performed at a temperature of 190° C. to a draw ratio of 1.4; and the one-stage relaxation was performed at a temperature of 102° C. to a total relaxation ratio of 2.7%.

The fibers after the heat-setting of drawing were subjected to network processing, and then subjected to second oiling with a Gaussian oiling agent. The interlacing pressure was 0.4 MPa, and the total oil picking up was 1.1%.

The tows after the second oiling were wound and formed using a twin-roller winding machine, at a winding speed of 2700 m/min, and a winding tension of 700 cN, to obtain the regenerated polyester industrial yarn for the anti-ultraviolet marine hawser.

Example 3

Preparation of Regenerated Polyester Bottle Chip

The waste polyester was recovered, and an automatic control cleaning technology was adopted. The recovered waste polyester was placed into a washing device and subjected to first washing, to mainly remove various non-polyester substances such as label paper, bottle caps, impurities on the polyester bottle. Qualified products were manually screened from the polyester bottle washed through the first washing, and crushed, and subjected to second washing, rinsing, dehydrating, and drying, to obtain the regenerated polyester bottle chip.

Preparation of an Anti-Ultraviolet Agent, an Anti-Bacterial Agent and a Waterproof and Acid- and Alkali-Resistant Slurry Raw materials for the anti-ultraviolet agent consisted of: in parts by weight, 20 parts of polypropylene resin, 7 parts of carbon nanotubes, 6 parts of nano titanium dioxide, 8 parts of nano zinc oxide, 7 parts of polyphenylene sulfide, 6 parts of butyl acrylate, 3 parts of zinc sulfate, 3 parts of attapulgite clay, 2 parts of diatomite, 3 parts of sodium α-olefin sulfonate, 2 parts of dibutyltin laurate, 2 parts of ammonium triphosphate, 2 parts of acrylamide, 4 parts of silane coupling agent KH-550, 35 parts of water, 3 parts of glycerol diacetate, and 5 parts of N,N-methylenebis(acrylamide).

20 Parts by weight of polypropylene resin, 7 parts by weight of polyphenylene sulfide, 6 parts by weight of butyl acrylate, and 8 parts by weight of nano zinc oxide were uniformly mixed, and a resulting mixture was stirred at 100° C. for 18 h, and cooled to room temperature to obtain a first material. 7 Parts by weight of carbon nanotubes, 6 parts by weight of nano titanium dioxide, 3 parts by weight of zinc sulfate, 3 parts by weight of attapulgite clay, 2 parts by weight of diatomite, 3 parts by weight of sodium α-olefin sulfonate, 2 parts by weight of dibutyltin laurate, 2 parts by weight of ammonium tripolyphosphate, 2 parts by weight of acrylamide, and 35 parts by weight of water were uniformly mixed, and a resulting mixture was heated to 115° C., kept at 115° C. for 4 hours. 5 Parts by weight of N,N-methylenebis(acrylamide) and 3 parts by weight of glycerol diacetate were added thereto, and they were uniformly mixed; a resulting mixture was cooled to 45° C., filtered, followed by washing; and the obtained product was dried at 120° C. for 2 hours, and then cooled to room temperature to obtain a second material. The first material, the second material, and 4 parts by weight of the silane coupling agent KH-550 were uniformly mixed; a resulting mixture was heated to 95° C., kept at 95° C. for 15 min, stirred at a rotational speed of 900 r/min for 10 min, and then cooled to room temperature, to obtain the anti-ultraviolet agent.

Raw materials for the antibacterial agent consisted of: in parts by weight, 25 parts of nano zinc oxide, 15 parts of diatomite, 6 parts of cobalt nitrate hexahydrate, 6 parts of ammonium bicarbonate, 4 parts of glacial acetic acid, 45 parts of anhydrous ethanol, 6 parts of silver nitrate, 4 parts of sodium hydroxide, and 30 parts of deionized water.

25 Parts by weight of nano zinc oxide and 6 parts by weight of ammonium bicarbonate were uniformly mixed, and the pH value of a resulting mixture was then adjusted to be neutral; a resulting system was stirred at 750 r/min for 25 min, then heated to 40° C., kept at 40° C. for 30 min, and then cooled to room temperature to obtain a mixture. The mixture and 6 parts by weight of cobalt nitrate hexahydrate were mixed and dispersed in 35 parts by weight of anhydrous ethanol, and 15 parts by weight of diatomite and 4 parts by weight of glacial acetic acid were then added thereto. A resulting mixture was uniformly mixed, heated and subjected to reaction in a water bath at 95° C. for 1 h, to obtain a mixed solution. 4 Parts by weight of sodium hydroxide was dissolved in 10 parts by weight of anhydrous ethanol, followed by magnetically stirring for 30 min; a resulting alkali solution and the mixed solution obtained above were uniformly mixed, and stirred for 35 min. A resulting mixture was heated and subjected to reaction in a water bath at 105° C. for 4 h, and 30 parts by weight of deionized water was then added thereto until the solution became into a milky white system. The resulting system was cooled to room temperature, magnetically stirred for 35 min, left to stand, and subjected to washing, and centrifuging, to obtain the antibacterial agent.

Raw materials for the waterproof and acid- and alkali-resistant layer consisted of: in parts by weight, 45 parts of a waterborne polyurethane, 25 parts of sodium alginate, 6 parts of silicon carbide, 20 parts of chitosan, 30 parts of sodium selenite, 6 parts of carbon nanotubes, 8 parts of titanium dioxide nanofibers, 35 parts of glycidyl ester epoxy resin, 10 parts of polytetramethylene ether glycol, 4 parts of butyl acrylate, 6 parts of polymaleic acid vinyl acid, 7 parts of dithiol succinate, 5 parts of polyurethane, 5 parts of dioctyl phthalate, 35 parts of deionized water, 15 parts of anhydrous ethanol, and 3 parts of acetic acid.

6 Parts by weight of silicon carbide and 15 parts by weight of sodium alginate were mixed, and a resulting mixture was ball milled in a ball mill for 25 min, then subjected to microwave heat treatment for 12 s, then taken out, and added to 30 parts by weight of waterborne polyurethane. A resulting mixture was ultrasonically dispersed for 18 min, cooled at 3° C. for 4 h, left to stand at 95° C. for 3 h, and filtered, followed by drying at 50° C., and ball-milled until the particle size was 35 nm, to obtain the modified silicon carbide. 30 Parts by weight of sodium selenite was dissolved in 20 parts by weight of deionized water, to obtain a sodium selenite solution with a concentration of 30 mg/L. 20 Parts by weight of chitosan was added to the sodium selenite solution, and a resulting mixture was uniformly mixed, heated to 60° C., followed by uniformly stirring. A resulting mixture was subjected to rotatory evaporation under vacuum at a temperature of 60° C., and irradiated under ultraviolet rays of 2400 $\mu W/cm^2$ for 4 min, and the irradiation was then stopped for 8 min. The resulting mixture was subjected to heat preservation for 45 min, and freeze-dried, to obtain the modified chitosan. 6 Parts by weight of carbon nanotubes and modified chitosan were mixed, 15 parts by weight of deionized water was then added thereto, and a resulting mixture was ultrasonically dispersed for 15 min. 8 Parts by weight of titanium dioxide nanofibers, the modified silicon carbide, and 3 parts by weight of acetic acid were uniformly mixed, and 35 parts by weight of glycidyl ester epoxy resin and 15 parts by weight of anhydrous ethanol were added thereto. A resulting mixture was heated to 60° C., kept at 60° C. while stirring for 45 minutes, and defoamed, to obtain a mixed stock solution. 10 Parts by weight of polytetramethylene ether glycol, 4 parts by weight of butyl acrylate, 6 parts by weight of polymaleic acid vinyl acid, 7 parts by weight of dithiol succinate, 5 parts by weight of polyurethane, and 5 parts by weight of dioctyl phthalate were uniformly mixed, heated to 125° C., and kept at 125° C. for 30 min. 15 Parts by weight of the waterborne polyurethane and 10 parts by weight of sodium alginate were added thereto, and a resulting mixture was further heated to 170° C., kept at 170° C. for 45 min, and then cooled to room temperature. The mixed stock solution was then added thereto, and a resulting mixture was uniformly mixed, heated to 90° C., kept at 90° C. for 3 h, stirred at a rotational speed of 2500 r/min for 20 min, and cooled to room temperature, to obtain the waterproof and acid-resistant alkali-resistant slurry.

The prepared anti-ultraviolet agent and regenerated polyester bottle chip were blended in a mass ratio of 5:95, and polymerized into an anti-ultraviolet modified polyester chip, by means of a melt-free plastic granulation system. The obtained anti-ultraviolet modified polyester chip was tackified by a vertical tackifying reactor, to obtain a high-viscosity anti-ultraviolet modified polyester chip having an intrinsic viscosity of 1.070 dl/g. The vertical tackifying reactor had four sections, namely, crystallizer, reactor, finished product conveying section, and nitrogen purification section; the inlet temperature of the crystallizer was 180° C., the internal temperature of the reactor was 175-225° C., the outlet temperature of the reactor was 155° C., the temperature of the finished product conveying section was 37° C., the pressure of the nitrogen purification section was 32 kPa, and a time for the tackifying reaction was 80 h.

The regenerated polyester bottle chip and the antibacterial agent were mixed in a mass ratio of 59.5:40.5, and a resulting mixture was subjected to melt granulation, to obtain the antibacterial master batch.

The obtained high-viscosity anti-ultraviolet modified polyester chip was conveyed to a screw extruder; the antibacterial master batch obtained above was added into the screw extruder through an online addition process, and melt-mixed together with the high-viscosity anti-ultraviolet modified polyester chip, to form a spinning melt. The spinning melt was metered by means of a metering pump, filtered using a filtering system, then sprayed out through a spinneret, and cooled by side blowing to form a tow. The spinneret was a different-filament spinneret; temperature of zones of the screw rod were 302° C., 302° C., 300° C., 295° C., 293° C., 293° C.; the metering pump was operated at a rotational speed of 18 r/min; and a temperature of a slow cooling zone was 325° C.

The prepared waterproof acid-resistant and alkali-resistant slurry was sprayed onto the surface of the tow obtained above to form a waterproof and acid-resistant and alkali-resistant layer; by an oil pulley, the first oiling was performed with Matsumoto GXM-100 spinning oiling agent on the tow with the waterproof and acid-resistant and alkali-resistant layer sprayed thereon; and a first oiling agent pump had a rotating speed of 32 r/min; a second oiling agent pump had a rotating speed of 24 r/min; and an oil picking up was 0.8%.

The tow after the first oiling was subjected to heat-setting of two-stage drawing and one-stage relaxation. The first-stage drawing was performed at a temperature of 132° C. to a draw ratio of 4.3; the second-stage drawing was performed at a temperature of 195° C. to a draw ratio of 1.6; and the one-stage relaxation was performed at a temperature of 105° C. to a total relaxation ratio of 3.0%.

The fibers after the heat-setting of drawing were subjected to network processing, and then subjected to second oiling with a Gaussian oiling agent. The interlacing pressure was 0.45 MPa, and the total oil picking up was 1.3%.

The tows after the second oiling were wound and formed using a twin-roller winding machine, at a winding speed of 2800 m/min, and a winding tension of 800 cN, to obtain the regenerated polyester industrial yarn for the anti-ultraviolet marine hawser.

Comparative Example 1

This comparative Example was performed according to the procedures as described in Example 3, except that no antibacterial agent was added.

Comparative Example 2

This comparative Example was performed according to the procedures as described in Example 3, except that a waterproof and acid- and alkali-resistant layer was not sprayed onto the surface of the tow.

Comparative Example 3

This comparative Example was performed according to the procedures as described in Example 3, except that no anti-ultraviolet agent was added.

Comparative Example 4

This comparative Example was performed according to the procedures as described in Example 3, except that the second oiling was not performed.

Bacteriostatic Performance Test

The polyester industrial yarns dedicated to a marine hawser prepared in Examples 1-3 were separately subjected to bacteriostatic tests against *Staphylococcus aureus, Pseudomonas aeruginosa, Pasteurella multocida, Escherichia coli*, and *Candida albicans*, respectively. After 48 hours, the antibacterial rates of the polyester industrial yarns dedicated to a marine hawser prepared in Examples 1-3 against *Staphylococcus aureus, Pseudomonas aeruginosa, Pasteurella multocida, Escherichia coli*, and *Candida albicans* were 99.7%, 99.6%, 99.8% and 99.9%, respectively. Also, the polyester industrial yarns dedicated to a marine hawser after being soaked in seawater for two months were again subjected to bacteriostatic tests against *Staphylococcus aureus, Pseudomonas aeruginosa, Pasteurella multocida, Escherichia coli*, and *Candida albicans*, respectively. Finally, the antibacterial rates of the polyester industrial yarns dedicated to a marine hawser tested against *Staphylococcus aureus, Pseudomonas aeruginosa, Pasteurella multocida, Escherichia coli*, and *Candida albicans* were 98.7%, 98.6%, 98.6% and 98.7%, respectively. Thus, it may be seen that the polyester industrial yarn dedicated to a marine hawser prepared in the present disclosure has efficient bacteriostatic performance and long-lasting bacteriostatic performance.

Acid/Alkali Resistance Test

The polyester industrial yarn dedicated to a marine hawser obtained in Example 3 was used as an experimental sample, and the polyester industrial yarn dedicated to a marine hawser obtained in Comparative Example 2 was used as a control sample. 10 experimental samples and 10 control samples were prepared, and subjected to fracture strength tests under the same conditions. The test results were averaged. 10 experimental samples and 10 control samples were divided into two groups for comparison, each group including 5 experimental samples and 5 control samples. For the first group, the experimental samples and the control samples were separately immersed in a 2 mol/L sulfuric acid solution in a water bath at 50° C. for 3 h. For the second group, the samples were separately immersed in a sodium hydroxide solution with a pH value of 10 in a water bath at 50° C. for 3 h. The fracture strength tests were then performed. The results are shown in Table 1.

TABLE 1

Results of acid/alkali resistance tests of products obtained in Example 3 and Comparative Example 2

| | Initial fracture strength cN/dtex | Fracture strength after immersing in 2 mol/L sulfuric acid solution in a water bath at 50° C. for 3 h cN/dtex | Fracture strength loss rate by acid treatment % | Fracture strength after immersing in sodium hydroxide solution with a pH value of 10 in a water bath at 50° C. for 3 h cN/dtex | Fracture strength loss rate by alkali treatment % |
|---|---|---|---|---|---|
| Example 3 | 7.58 | 7.16 | 5.54% | 7.38 | 2.64% |
| Comparative Example 2 | 7.42 | 6.97 | 6.06% | 6.34 | 14.56% |

As may be seen from the data in Table 1, the polyester industrial yarn with the waterproof acid-alkali layer of the present disclosure has significant acid- and alkali-resistance, resulting in improved fracture strength of the polyester industrial yarn.

Anti-Ultraviolet Performance Test

The polyester industrial yarns dedicated to a marine hawser obtained in Example 3 and Comparative Example 3 were placed under a strong intensity level of ultraviolet, irradiated for 30 days, 60 days, 90 days and 120 days, respectively, and subjected to fracture strength tests after irradiating for 30 days, 60 days, and 90 days, respectively. The results of fracture strength are shown in Table 2.

TABLE 2

Fracture strength of products obtained in Example 3 and Comparative Example 3 under ultraviolet irradiation for different days

| | Initial fracture strength cN/dtex | Fracture strength after 30 days cN/dtex | Fracture strength after 60 days cN/dtex | Fracture strength after 90 days cN/dtex |
|---|---|---|---|---|
| Example 3 | 7.54 | 7.47 | 7.45 | 7.41 |
| Comparative Example 3 | 7.57 | 7.31 | 7.12 | 6.88 |

As may be seen from Table 2, when the polyester industrial yarn dedicated to a marine hawser prepared using the anti-ultraviolet agent according to the present disclosure is used, its fracture strength does not significantly change even after being irradiated for 30 days, 60 days and 90 days, indicating that the polyester industrial yarn dedicated to a marine hawser prepared using the anti-ultraviolet agent according to the present disclosure has great anti-ultraviolet and anti-aging performance, and the anti-ultraviolet performance is stable and long-lasting.

Wear Resistance Test

The polyester industrial yarns dedicated to a marine hawser obtained in Examples 1-3 and Comparative Examples 1-4 were separately subjected to wet friction tests in a seawater environment under a load of 0.41 cN/dtex. The results of wear-resistance cycles are shown in Table 3.

TABLE 3

Results of wear resistance tests of products obtained in Examples 1-3 and Comparative Example 1-4

| | Example 1 | Example 2 | Example 3 | Comparative Example 1 | Comparative Example 2 | Comparative Example 3 | Comparative Example 4 |
|---|---|---|---|---|---|---|---|
| Wear resistance cycles under a load of 0.41 cN/dtex | 2375 | 2434 | 2338 | 2393 | 2427 | 2472 | 2108 |

As may be seen from Table 3, the polyester industrial yarn dedicated to a marine hawser prepared in the present disclosure has great wear resistance and seawater-repellent under the action of the anti-ultraviolet agent, the antibacterial agent, the waterproof acid-resistant and alkali-resistant layer, and the second oiling.

Anti-Creep Performance Test

According to the present disclosure, the polyester industrial yarns dedicated to a marine hawser obtained in Examples 1-3 and Comparative Example 2 were separately subjected to anti-creep performance tests. Specifically, the polyester industrial yarns dedicated to a marine hawser obtained in Example 1, Example 2, Example 3, and Comparative Example 2, with the same denier, were separately subjected to creep performance tests. Based on previous experiments, the ratio value of 5%-elongation strength/total strength could reflect the initial modulus level, and to some extent, it could also reflect the creep performance. Therefore, the ratio value of 5%-elongation strength/total strength is used to characterize the dimensional stability of the polyester industrial yarn dedicated to a marine hawser. The results are shown in Table 4.

TABLE 4

Results of anti-creep performance tests of products obtained in Examples 1-3 and Comparative Example 2

| | Example 1 | Example 2 | Example 3 | Comparative Example 2 |
|---|---|---|---|---|
| 5%-elongation strength/total strength | 43% | 41% | 45% | 32% |

As may be seen from Table 4, compared with Comparative Example 2, the ratio values of 5%-elongation strength to the total strength of the polyester industrial yarns dedicated to a marine hawser obtained in Examples 1-3 are significantly increased. Thus, the polyester industrial yarn dedicated to a marine hawser prepared in the present disclosure has better dimensional stability.

In conclusion, in the present disclosure, by the high-viscosity anti-ultraviolet modified polyester chip as a raw material, which is prepared by adding the anti-ultraviolet agent, the prepared polyester industrial yarn has great anti-ultraviolet and anti-aging performance, and the anti-ultraviolet performance is stable and long-lasting. Meanwhile, by the antibacterial master batch as a raw material, which is prepared by adding the antibacterial agent and mixing with the regenerated polyester chip, the prepared polyester industrial yarn has efficient antibacterial performance. In addition, the waterproof and acid- and alkali-resistant layer is sprayed onto the surface of the tow, so that the obtained polyester industrial yarn has good waterproof performance and acid- and alkali-resistance, improved corrosion resistance and wear resistance, and long-lasting waterproof performance. Therefore, in the synergistic effect of the anti-ultraviolet agent, the antibacterial agent, and the waterproof and acid- and alkali-resistant layer, the polyester industrial yarn dedicated to a marine hawser prepared by the method according to the present disclosure not only has high strength, good wear resistance, great anti-ultraviolet durability, but also has good antibacterial performance, corrosion resistance, and seawater resistance durability, thereby having a remarkably prolonged service life.

The above are only optional embodiments of the present disclosure, and could not be construed as a limitation on any form and essence of the present disclosure. It should be noted that, for a person of ordinary skill in the art, several improvements and supplements would be made without departing from the method of the present disclosure, and these improvements and supplements should also be deemed as falling within the scope of the present disclosure. Those skilled in the art, without departing from the spirit and scope of the present disclosure, could make equivalent variations of changes, modifications, and evolution using the above-disclosed technical contents, all of which are equivalent embodiments of the present disclosure. Also, any equivalent variations of changes, modifications, and evolution made according to the substantive techniques of the present disclosure still fall within the scope of the technical solutions of the present disclosure.

In some embodiments, in view of the technical problem that existing polyester industrial fibers are easily corroded by acid/alkali and aged, due to the influence of factors such as salts, bacteria, sunlight in seawater environment, thereby leading to a short service life, the present disclosure may provide a polyester industrial yarn dedicated to a marine hawser and preparation method thereof. It may not only have high strength, good wear resistance, great anti-ultraviolet performance, good antibacterial performance, corrosion resistance, seawater resistance, and antistatic properties, but also may have a significantly improved service life.

In other embodiments, compared with the prior art, some embodiments of technical solutions according to the present disclosure may have one or more of the following effects.

(1) Embodiments of the present disclosure may provide a method for preparing a polyester industrial yarn dedicated to a marine hawser. In the present disclosure, by the high-viscosity anti-ultraviolet modified polyester chip as a raw material, which is prepared by adding the anti-ultraviolet agent, the prepared polyester industrial yarn may have great anti-ultraviolet and anti-aging performance, and the anti-ultraviolet performance may be stable and long-lasting. Meanwhile, by the antibacterial master batch as a raw material, which is prepared by adding the antibacterial agent and mixing it with the regenerated polyester chip, the prepared polyester industrial yarn may have efficient antibacterial performance. In addition, by spraying the waterproof and acid- and alkali-resistant layer onto the surface of the tow, the obtained polyester industrial yarn may have good waterproof performance and acid- and alkali-resistance, improved corrosion resistance and wear resistance, and long-lasting waterproof performance. Therefore, in the synergistic effect of the anti-ultraviolet agent, the antibacterial agent, and the waterproof and acid- and alkali-resistant layer, the polyester industrial yarn dedicated to a marine hawser prepared by the method according to the present disclosure may not only have high strength, good wear resistance, great anti-ultraviolet durability, but may also have good antibacterial performance, corrosion resistance, and great seawater resistance durability, thereby which may help to have a remarkably prolonged service life.

(2) Embodiments of the present disclosure may provide a method for preparing a polyester industrial yarn dedicated to a marine hawser. In the anti-ultraviolet agent prepared in the present disclosure, polypropylene resin may act as a base resin, nano zinc oxide, nano titanium dioxide, zinc nitrate, attapulgite clay, and diatomite act as an anti-ultraviolet reinforcing filler system. The anti-ultraviolet reinforcing filler system may contain zinc elements and titanium elements, each in a great amount. Meanwhile, zinc elements and titanium elements may be present in a great amount such that in the effect of porous adsorption of carbon nanotubes, an oxide film formed from the zinc elements and titanium elements fills interspaces of carbon nanotubes, thereby forming a dense oxide film on a surface of polyester industrial yarn(s). When ultraviolet rays of sunlight irradiate the surface of the polyester industrial yarn(s), due to the absorption effect of ultraviolet rays by the zinc elements and the titanium elements, the damage of the ultraviolet rays to the polyester industrial yarn(s) may be greatly reduced, which may significantly improve the anti-ultraviolet performance of the polyester industrial yarn(s), and thereby prolongs the service life of the polyester industrial yarn(s). Moreover, the surface hydroxyl groups of the anti-ultraviolet reinforcing filler system may be modified by grafting with the silane coupling agent KH-550, which may achieve the bonding of the anti-ultraviolet reinforcing filler system and the base resin, and may improve the stability of the anti-ultraviolet performance thereof, thereby resulting in long-lasting anti-ultraviolet performance. Therefore, the anti-ultraviolet and anti-aging performance of polyester industrial yarn(s) and marine hawser may be effectively improved, thereby prolonging the service life thereof.

(3) Embodiments of the present disclosure may provide a method for preparing a polyester industrial yarn dedicated to a marine hawser. In the prepared antibacterial agent, diatomite may act as a support, cobalt nitrate hexahydrate acts as a dopant, the nano zinc oxide quantum dots may act as main antibacterial components; the zinc oxide quantum dots, due to their size limitation and the quantum confinement effect, in combination with their coupling with $Co^{2+}$, could effectively inhibit the recombination of photo-generated electrons and holes on the surface of the zinc oxide; Co-doped zinc oxide quantum dots may be loaded on the surface of the diatomite; and in the effect of acetic acid, in the diatomite, the oxide impurity content may be reduced, the $SiO_2$ content may be increased, and the specific surface area and pore volume may also be increased, so that the diatomite may have a huge specific surface area and a high absorptivity, resulting in bacteria absorbed on the surface thereof. Therefore, there may be a synergistic effect together with the Co-doped zinc oxide quantum dots loaded on the surface of the diatomite and in the pores, in terms of efficient antibacterial effect, thereby killing the bacteria. Also, in the diatomite crystal lattice, isomorphous replacement easily occurs between $Si^{4+}$ ions and other low-valence cations, so that the bacteria are adsorbed, resulting in improved antibacterial performance. Therefore, the polyester industrial yarn prepared using the antibacterial agent in the present disclosure has efficient antibacterial performance and a long-acting bacteriostasis, thereby prolonging the service life of the polyester industrial yarn.

(4) Embodiments of the present disclosure may provide a method for preparing a polyester industrial yarn dedicated to a marine hawser. In the waterproof and acid- and alkali-resistant layer, the silicon carbide may be modified by polyurethane, so that the dispersion of the silicon carbide may be enhanced, and the interface fusion of the waterproof and acid- and alkali-resistant layer and the substrate may be thereby promoted, resulting in enhanced mechanical properties of the polyester industrial yarn. Moreover, the presence of the polyurethane modified silicon carbide could block the invasion of acid and alkali molecules, thereby improving acid- and alkali-resistance of the polyester industrial yarn. Meanwhile, the use of titanium dioxide nanofibers could increase the specific surface area of titanium dioxide, and meanwhile plays a hydrophobic role on the surface of the polyester industrial yarn, thereby preventing the erosion of rainwater on the polyester industrial yarn in rainy days. In addition, the use of the modified chitosan could improve the bonding of chitosan amino groups and selenium, improve the stability of the modified chitosan, improve the flexibility and cohesiveness of the chitosan, and significantly improve the mixing and dispersing effect of chitosan and carbon nanotubes, and the bonding strength therebetween, resulting in improved corrosion resistance and strength of fibers, and thereby improved corrosion resistance and structural strength of the polyester industrial yarn. The chitosan could be easily dissolved in a weak acid solvent, the dissolved solution may contain amino groups; the amino groups may combine with bacteria by combining with negatively-charged electrons, so that the bacteria undergo structure change or energy transfer, which may cause the bacteria to die, thereby achieving the bacteriostatic effect. The permeation effect of the waterborne polyurethane, together with the role of polytetramethylene ether glycol, butyl acrylate, polymaleic acid vinyl acid, dithioglycol succinic acid, polyurethane, dioctyl phthalate as an anti-wrinkle hot melt adhesive, results in a firm attachment to the surface of the polyester industrial yarn, to prevent the falling off of the waterproof and acid- and alkali-resistant layer. Therefore, the durability of waterproof performance and acid- and alkali-resistance of the polyester industrial yarn may be effectively improved, thereby prolonging the service life of the polyester industrial yarn.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Unless indicated otherwise, not all steps listed in the various figures need be carried out in the specific order described.

What is claimed is:

1. A method for preparing a polyester industrial yarn dedicated to a marine hawser, comprising:

S1, preparing a regenerated polyester chip;

S2, blending the regenerated polyester chip in S1 with an anti-ultraviolet agent, polymerizing a resulting mixture of the regenerated polyester chip in S1 and the anti-ultraviolet agent, and granulating and tackifying the polymerized resulting mixture to obtain a high-viscosity anti-ultraviolet modified polyester chip;

S3, mixing the regenerated polyester chip in S1 with an antibacterial agent and melt granulating a resulting mixture of the regenerated polyester chip in S1 and the antibacterial agent to obtain an antibacterial master batch;

S4, mixing the high-viscosity anti-ultraviolet modified polyester chip obtained in S2 and the antibacterial master batch obtained in S3, extruding and melting the resulting mixture to form a spinning melt, and metering and spinning to form a tow;

S5, spraying a waterproof, acid-resistant, and alkali-resistant layer onto a surface of the tow obtained in S4;

S6, subjecting the tow in S5 to first oiling; and

S7, subjecting the tow in S6 to heat-setting of two-stage drawing and one-stage relaxation, network processing, second oiling, and winding forming to obtain the polyester industrial yarn dedicated to the marine hawser;

wherein in S5, raw materials for the waterproof, acid-resistant, and alkali-resistant layer comprise, in parts by weight:

30-45 parts of a waterborne polyurethane,
15-25 parts of a dispersant,
4-6 parts of silicon carbide,
10-20 parts of chitosan,
15-30 parts of sodium selenite,
5-6 parts of carbon nanotubes,
6-8 parts of titanium dioxide nanofibers,
20-35 parts of glycidyl ester epoxy resin,
3-10 parts of polytetramethylene ether glycol,
2-4 parts of butyl acrylate,
3-6 parts of polymaleic acid vinyl acid,
4-7 parts of dithiol succinate,
3-5 parts of polyurethane,
2-5 parts of dioctyl phthalate,
25-35 parts of deionized water,
10-15 parts of anhydrous ethanol, and
2-3 parts of acetic acid;

wherein the dispersant is sodium alginate.

2. The method of claim 1, wherein the waterproof, acid-resistant, and alkali-resistant layer is prepared by:

mixing silicon carbide and a part of the dispersant, and ball milling a resulting mixture in a ball mill for 15-25 min, performing microwave heat treatment for 6-12 s, and taking out; adding a resulting product into a part of the waterborne polyurethane, ultrasonically dispersing for 8-18 min, cooling at a temperature of 0-3° C. for 2-4 h, leaving to stand at a temperature of 85-95° C. for 3-5 h, filtering, drying a resulting solid at a temperature of 40-50° C., and ball milling to a particle size of 15-50 nm, to obtain a modified silicon carbide;

dissolving sodium selenite in a part of deionized water to obtain a sodium selenite solution with a concentration of 15-35 mg/L, adding chitosan into the sodium selenite solution, mixing, heating a resulting mixture to a temperature of 50-60° C., stirring, subjecting a resulting mixture to rotatory evaporation under vacuum at a temperature of 55-60° C., performing ultraviolet intermittent irradiation, then performing heat preservation for 30-45 min, and freeze-drying, to obtain a modified chitosan;

mixing the carbon nanotubes and the modified chitosan, adding a remaining deionized water, ultrasonically dispersing for 10-15 min, adding titanium dioxide nanofibers, the modified silicon carbide and acetic acid thereto, mixing, adding glycidyl ester epoxy resin and anhydrous ethanol thereto, heating a resulting mixture to a temperature of 40-60° C., keeping at 40-60° C. while stirring for 30-45 min, and defoaming to obtain a mixed stock solution; and mixing polytetramethylene ether glycol, butyl acrylate, polymaleic acid vinyl acid, dithiol succinate, polyurethane and dioctyl phthalate, heating a resulting mixture to a temperature of 110-130° C., keeping at 110-130° C. for 10-30 min, then adding a remaining waterborne polyurethane and a remaining dispersant thereto, mixing, further heating to a temperature of 150-180° C., keeping at 150-180° C. for 30-50 min, cooling to room temperature; and adding the mixed stock solution thereto, mixing, heating to a temperature of 80-90° C., keeping at 80-90° C. for 1-3 h, stirring at a rotating speed of 1500-2500 r/min for 20-40 min, cooling to room temperature, and spraying onto the surface of the tow.

3. The method of claim 1, wherein in S2, a mass ratio of the anti-ultraviolet agent to the regenerated polyester chip is in a range of (1-5):(95-99).

4. The method of claim 3, wherein raw materials for the anti-ultraviolet agent comprise, in parts by weight:

10-20 parts of polypropylene resin,
5-7 parts of carbon nanotubes,
2-6 parts of nano titanium dioxide,
4-8 parts of nano zinc oxide,
5-7 parts of polyphenylene sulfide,
2-6 parts of butyl acrylate,
2-3 parts of zinc sulfate,
0.5-3 parts of attapulgite clay,
1-2 parts of diatomite,
1-3 parts of sodium α-olefin sulfonate,
1-2 parts of dibutyltin laurate,
1-2 parts of ammonium triphosphate,
1-2 parts of acrylamide,
1-4 parts of silane coupling agent KH-550,
20-35 parts of water,
1-3 parts of glycerol diacetate, and
2-5 parts of N,N-methylenebis (acrylamide).

5. The method of claim 1, wherein raw materials for the anti-ultraviolet agent comprise, in parts by weight:

10-20 parts of polypropylene resin,
5-7 parts of carbon nanotubes,
2-6 parts of nano titanium dioxide,
4-8 parts of nano zinc oxide,
5-7 parts of polyphenylene sulfide,
2-6 parts of butyl acrylate,
2-3 parts of zinc sulfate,
0.5-3 parts of attapulgite clay,
1-2 parts of diatomite,
1-3 parts of sodium α-olefin sulfonate,
1-2 parts of dibutyltin laurate,
1-2 parts of ammonium triphosphate,
1-2 parts of acrylamide,
1-4 parts of silane coupling agent KH-550,
20-35 parts of water, 1-3 parts of glycerol diacetate, and
2-5 parts of N,N-methylenebis(acrylamide).

6. The method of claim 5, wherein the anti-ultraviolet agent is prepared by:

mixing polypropylene resin, polyphenylene sulfide, butyl acrylate, and nano zinc oxide, stirring at a temperature of 85-100° C. for 18-25 h, and cooling to room temperature, to obtain a first material;

mixing carbon nanotubes, nano titanium dioxide, zinc sulfate, attapulgite clay, diatomite, sodium α-olefin sulfonate, dibutyltin laurate, ammonium tripolyphosphate, acrylamide, and water, heating a resulting mixture to a temperature of 85-115° C., keeping at 85-115° C. for 2-6 hours, adding N,N-methylenebis(acrylamide) and glycerol diacetate thereto, mixing, then cooling to a temperature of 35-60° C., filtering, washing, drying at a temperature of 90-120° C. for 2-7 hours, and cooling to room temperature, to obtain a second material; and mixing the first material, the second material, and the silane coupling agent KH-550, heating a resulting mixture to a temperature of 85-95° C., keeping at 85-95° C. for 15-25 min, stirring at a rotational speed of 600-900 r/min for 10-20 min, and then cooling to room temperature, to obtain the anti-ultraviolet agent.

7. The method of claim 1, wherein in S3, a mass ratio of the regenerated polyester chip to the antibacterial agent is in a range of (59.5-69.5):(30.5-40.5).

8. The method of claim 1, wherein raw materials for the antibacterial agent comprise, in parts by weight:

15-25 parts of nano zinc oxide,
7-15 parts of diatomite,
3-6 parts of cobalt nitrate hexahydrate,
2-6 parts of ammonium bicarbonate,
2-4 parts of glacial acetic acid,
20-50 parts of anhydrous ethanol,
2-6 parts of silver nitrate,
2-4 parts of sodium hydroxide, and
15-30 parts of deionized water.

9. The method of claim 1, wherein raw materials for the antibacterial agent comprise, in parts by weight:

15-25 parts of nano zinc oxide,
7-15 parts of diatomite,
3-6 parts of cobalt nitrate hexahydrate,
2-6 parts of ammonium bicarbonate,
2-4 parts of glacial acetic acid,
20-50 parts of anhydrous ethanol,
2-4 parts of sodium hydroxide, and
15-30 parts of deionized water.

10. The method of claim 9, wherein the antibacterial agent is prepared by:

mixing nano zinc oxide and ammonium bicarbonate, adjusting a pH value of a resulting system to neutral, stirring at a rotating speed of 550-750 r/min for 25-45 min, heating to a temperature of 30-40° C., keeping at 30-40° C. for 10-30 min, cooling to room temperature to obtain a mixture, mixing the mixture and cobalt nitrate hexahydrate, dispersing in a part of anhydrous ethanol, adding diatomite and glacial acetic acid thereto, mixing, and subjecting a resulting mixture to reaction in a water bath at a temperature of 80-95° C. for 1-3 hours, to obtain a mixed solution; and dissolving sodium hydroxide in a remaining anhydrous ethanol, magnetically stirring for 15-30 min, mixing a resulting alkali solution with the mixed solution, stirring for 25-35 min, subjecting a resulting mixture to reaction in a water bath at a temperature of 80-100° C. for 4-6 h, then adding deionized water thereto until a solution becomes into a milky white system, cooling to room temperature, magnetically stirring for 10-35 min, leaving a resulting system to stand, washing, and centrifuging, to obtain the antibacterial agent.

11. The method of claim 1, wherein in S7, during the heat-setting of two-stage drawing and one-stage relaxation:

a first-stage drawing is performed at a temperature of 128-132° C. to a draw ratio of 4.1-4.3;

a second-stage drawing is performed at a temperature of 185-195° C. to a draw ratio of 1.3-1.6; and the one-stage relaxation is performed at a temperature of 97-105° C. to a total relaxation ratio of 2.5-3.0%.

12. The method of claim 1, wherein in S4:

the high-viscosity anti-ultraviolet modified polyester chip obtained in S2 is conveyed to a screw extruder;

the antibacterial master batch obtained in S3 is added into the screw extruder through an online addition process, and melt-mixed together with the high-viscosity anti-ultraviolet modified polyester chip, and extruded to form a spinning melt; and the spinning melt is metered by means of a metering pump, filtered using a filtering system, then sprayed out through a spinneret, and cooled by side blowing, to form the tow.

13. The method of claim 12, wherein:

the high-viscosity anti-ultraviolet modified polyester chip has an intrinsic viscosity of 1.050-1.070 dl/g;

temperatures of zones of the screw extruder are 292-302° C., 296-302° C., 293-300° C., 290-295° C., 287-293° C., and 287-293° C.;

the metering pump is operated at a rotational speed of 16-18 r/min; and a temperature of a slow cooling zone is in a range of 315-325° C.

14. The method of claim 12, wherein the spinneret is a different-filament spinneret.

15. The method of claim 1, wherein in S6:

the first oiling is performed by an oil pulley;

an oiling agent for the first oiling is a spinning oiling agent;

a first oiling agent pump has a rotating speed of 28-32 r/min;

a second oiling agent pump has a rotating speed of 20-24 r/min; and an oil picking up is in a range of 0.5-0.8%.

16. The method of claim 1, wherein in S7:

an oiling agent for the second oiling is a Gaussian oiling agent;

an interlacing pressure is in a range of 0.35-0.45 MPa;

a total oil picking up is in a range of 1.0-1.3%; and the winding forming is performed by a twin-roller winding machine at a winding speed of 2600-2800 m/min and a winding tension of 600-800 cN.

* * * * *